US009963276B1

(12) United States Patent
Arthurs et al.

(10) Patent No.: US 9,963,276 B1
(45) Date of Patent: May 8, 2018

(54) LATCH AND RELEASE MECHANISMS FOR WASTE CONTAINERS

(71) Applicant: The Eastern Company, Cleveland, OH (US)

(72) Inventors: Scott Arthurs, Brunswick, OH (US); Lee S. Weinerman, Medina, OH (US); Keith A. Braun, Brunswick, OH (US)

(73) Assignee: THE EASTERN COMPANY, Cleveland, OH (US)

( * ) Notice: Subject to any disclaimer, the term of this patent is extended or adjusted under 35 U.S.C. 154(b) by 189 days.

(21) Appl. No.: 14/695,587

(22) Filed: Apr. 24, 2015

Related U.S. Application Data

(60) Provisional application No. 61/984,428, filed on Apr. 25, 2014, provisional application No. 61/984,464, filed on Apr. 25, 2014, provisional application No. 62/081,365, filed on Nov. 18, 2014.

(51) Int. Cl.

| | |
|---|---|
| ***E05C 1/04*** | (2006.01) |
| ***B65D 45/02*** | (2006.01) |
| ***B65F 1/16*** | (2006.01) |
| *E05C 1/00* | (2006.01) |
| *E05C 1/06* | (2006.01) |
| *E05C 5/02* | (2006.01) |
| *E05C 9/00* | (2006.01) |
| *E05C 9/10* | (2006.01) |

(52) U.S. Cl.
CPC ..... *B65D 45/02* (2013.01); *B65F 1/16* (2013.01)

(58) Field of Classification Search
CPC ..... B65D 45/02; B65F 1/16; B65F 1/1615; B65F 1/1646
USPC ..... 292/4, 32, 41, 57, 138, 145, 34; 220/908, 315, 230
See application file for complete search history.

(56) References Cited

U.S. PATENT DOCUMENTS

| | | | | | |
|---|---|---|---|---|---|
| 480,148 | A * | 8/1892 | Theby | E05C 9/043 | 292/34 |
| 1,438,376 | A * | 12/1922 | Jeanmaire | A01J 9/06 | 220/314 |
| 1,908,980 | A * | 5/1933 | Heyel | E05B 63/126 | 292/34 |
| 2,792,963 | A * | 5/1957 | Smith | B65D 45/02 | 220/248 |
| 3,091,356 | A * | 5/1963 | Simpkins | B65D 45/02 | 220/248 |

(Continued)

*Primary Examiner* — Kristina Fulton
*Assistant Examiner* — Faria Ahmad
(74) *Attorney, Agent, or Firm* — Ralph E. Jocke; Walker & Jocke

(57) ABSTRACT

A latch is usable for latching and automatically unlatching a lid operative to close a bin of a waste container. The latch includes a release weight that is moveable responsive to gravity from a first position to a second position to cause the latch to disengage from a release mechanism when the latch is rotated to one or more angular positions in a dump angular orientation. The latch and release mechanism are held in latched engagement when release slide bolts and latch slide bolts are engaged in extended positions. Movement of the release weight causes the latch slide bolts to move to retracted positions to enable disengagement of the release slide bolts and latch slide bolts. A release knob is operative responsive to manual movement in two different directions to enable the latch and release slide bolts to disengage.

28 Claims, 13 Drawing Sheets

(56) References Cited

U.S. PATENT DOCUMENTS 3,498,657 A * 3/1970 Fontana ..... E05B 17/0037 292/34
3,596,952 A * 8/1971 Hinkle ..... E05C 9/08 292/124
3,674,298 A * 7/1972 Vekony ..... B65D 45/02 292/258
3,809,414 A * 5/1974 Neunherz ..... A47D 7/02 292/4
3,991,595 A * 11/1976 Bahry ..... E05C 9/06 292/139
4,120,415 A * 10/1978 Hopkins ..... B30B 9/3042 220/315
5,015,021 A * 5/1991 Wyson ..... B65F 1/1615 292/230
5,078,295 A * 1/1992 Grant ..... B65D 45/02 220/318
5,105,967 A * 4/1992 Horpestad ..... B65F 1/1615 220/817
5,149,153 A * 9/1992 Drewry ..... B65F 1/1615 220/908
5,224,744 A * 7/1993 Michelutti ..... B65F 1/1615 220/908
5,415,314 A * 5/1995 McCollum ..... B65F 1/1615 220/264
5,419,598 A * 5/1995 Kreitzer ..... B65F 1/1615 292/205
5,683,126 A * 11/1997 De Vivo ..... B65F 1/1615 220/315
5,738,395 A * 4/1998 Probst ..... B65F 1/1615 220/315
6,030,019 A * 2/2000 Stiltner ..... B62D 33/037 292/39
6,047,999 A * 4/2000 Dixon, Jr. ..... E05B 63/18 292/32
6,053,541 A * 4/2000 Harris ..... E05B 51/02 292/138
6,199,714 B1 * 3/2001 Thompson ..... B65F 1/06 220/495.04
6,290,093 B1 * 9/2001 Obriot ..... B65F 1/1615 220/324
6,343,709 B1 * 2/2002 DeForrest ..... B65D 43/022 220/327
6,510,588 B2 * 1/2003 Eromaki ..... G06F 1/1616 16/280
6,666,485 B1 * 12/2003 Moret ..... B65F 1/1615 220/315
6,669,243 B2 * 12/2003 Katoh ..... B60R 7/06 292/34
6,733,053 B2 * 5/2004 Hodge ..... B65F 1/1615 292/285
6,793,084 B1 * 9/2004 Wunsch ..... B65D 77/0466 220/1.5
6,808,080 B2 * 10/2004 Spiers ..... B65F 1/1615 220/263
6,851,288 B2 * 2/2005 Howes ..... B65D 55/14 220/315
6,857,538 B2 * 2/2005 Lin ..... B65F 1/1607 220/254.3
7,036,852 B2 * 5/2006 Cho ..... E05B 83/30 292/142
7,182,373 B2 * 2/2007 Yamada ..... E05B 83/30 292/141
7,234,327 B2 * 6/2007 Howes ..... B65F 1/1615 220/315
7,455,333 B2 * 11/2008 Ookawara ..... E05B 83/30 292/34
7,506,902 B2 * 3/2009 Sheng ..... G03G 21/1666 16/221
7,549,552 B2 * 6/2009 Hasegawa ..... H01L 21/67373 206/710
7,712,186 B2 * 5/2010 Kang ..... E05D 11/1078 16/330
7,712,798 B2 * 5/2010 Kraus ..... E05B 1/0046 292/169
7,806,287 B2 * 10/2010 Rouns ..... B65F 1/1615 220/326
7,832,239 B2 * 11/2010 Kozuka ..... E05B 83/30 292/39
7,971,723 B1 * 7/2011 Chiu ..... H01L 21/67373 206/711
8,177,264 B2 * 5/2012 Iwakami ..... B63B 25/002 292/36
8,186,539 B2 * 5/2012 Lin ..... B65F 1/1607 220/263
8,235,233 B2 * 8/2012 Pehr ..... B65D 47/0838 215/201
8,313,126 B2 * 11/2012 Ferkovich ..... B65F 1/1615 292/11
8,403,374 B2 * 3/2013 Shimizu ..... E05B 83/30 292/137
8,479,944 B2 * 7/2013 Moore ..... B65F 1/1615 220/326
8,888,147 B2 * 11/2014 Blanck ..... B60R 7/04 292/34
8,910,821 B1 * 12/2014 Stravitz ..... B65F 1/06 220/495.04
9,573,757 B1 * 2/2017 Stravitz ..... B65F 1/06
9,580,243 B2 * 2/2017 Reeb ..... B65F 1/1646
2003/0006616 A1 * 1/2003 Katoh ..... B60R 7/06 292/32
2003/0189340 A1 * 10/2003 Kitzis ..... B65F 1/1615 292/145
2003/0201265 A1 * 10/2003 Lin ..... B65F 1/1607 220/254.3
2004/0256859 A1 * 12/2004 Yamada ..... E05B 83/30 292/32
2007/0163310 A1 * 7/2007 Ookawara ..... E05B 83/30 70/208
2010/0102575 A1 * 4/2010 Ferkovich ..... B65F 1/1615 292/259 R
2011/0036837 A1 * 2/2011 Shang ..... B65D 45/02 220/240
2012/0080890 A1 * 4/2012 Loret de Mola ..... E05B 5/00 292/157
2012/0146343 A1 * 6/2012 Zhao ..... H01H 3/12 292/145
2014/0238990 A1 * 8/2014 Banik ..... E05B 15/0093 220/324
2014/0367974 A1 * 12/2014 Keely ..... E05B 65/0014 292/60
2015/0008680 A1 * 1/2015 Suzuki ..... B60R 7/06 292/32
2016/0159569 A1 * 6/2016 Reeb ..... B65F 1/1615 220/315
2016/0257491 A1 * 9/2016 Manssourian ..... B65F 1/1615
2016/0362229 A1 * 12/2016 Hoskins ..... B65D 25/02
2017/0043950 A1 * 2/2017 Reeb ..... B65F 1/1615

* cited by examiner

LATCH AND RELEASE MECHANISMS FOR WASTE CONTAINERS

CROSS REFERENCE TO RELATED APPLICATIONS

This application claims benefit pursuant to 35 U.S.C. § 119(e) of Provisional Application Nos. 61/984,428 filed Apr. 25, 2014, 61/984,464 filed Apr. 25, 2014 and 62/081,365 filed Nov. 18, 2014, the disclosures of each of which are incorporated herein by reference in its entirety.

TECHNICAL FIELD

Exemplary embodiments relate to mechanical latches that selectively hold items in engagement and release such items from engagement. Exemplary embodiments further relate to latches used to selectively hold and release lids or covers of waste containers.

BACKGROUND

Waste containers are mechanical devices that are typically used to hold discarded items. An example of a waste container includes a trash can or bin that is typically used to temporarily store garbage or other waste items. Waste containers often have lids that help hold and isolate the contents of the waste container. For example, lids can prevent the contents of waste containers from being exposed to wind, rain and snow. Lids can contain undesirable odors of the contents. Lids can also prevent the contents of waste containers from being accessed by domestic and wild animals scavenging for food.

To avoid a lid from being opened at inappropriate times, the lid and/or the bin of the waste container to which the lid is attached may include a latch mechanism. Such latch mechanisms for waste containers may benefit from improvements.

SUMMARY

The following is a brief summary of subject matter that is described in greater detail herein. This summary is not intended to be limiting as to the scope of the claims.

In one example embodiment a latch mechanism may be configured to be mounted to a waste container that includes a bin and a cover which will be referred to herein as a lid. Such a bin of the waste container includes walls that bound an interior space or cavity and an opening into the interior cavity, which is coverable by the lid. Such a lid may be attached to the bin in a pivoting relationship such that the lid is operative to pivot with respect to the bin between an open position and a closed position relative to the opening into the interior cavity.

When the lid is in the closed position, the lid includes an inside surface facing the cavity and the lid includes an opposed outside surface. In the examples described herein, the latch mechanism may be in operative connection with either the bin or the lid. For example, in an example embodiment, the latch mechanism may be in operative connection with the inside wall surface of the bin of the waste container and a release mechanism may be in operative connection with the lid of the waste container.

The latch mechanism may automatically engage with the release mechanism in order to lock the lid in the closed position relative to the bin. However, it should be appreciated that in alternative embodiments the latch mechanism and release mechanism may be located in different locations. For example, the latch mechanism could be mounted to the lid of the container and be operative to engage with a release mechanism in operative connection with the bin. Also, in alternative embodiments, multiple outside release mechanisms may be mounted to the waste container such as on the lid and on an upper ledge of the bin.

In an example embodiment, the release mechanism mounted to the lid is operative to enable a human to manually disengage the lid from the latch mechanism so that the lid may pivot to its open position. However, it should also be appreciated that in some applications, the waste container may also need to be configured to enable the lid to automatically open without direct manual intervention.

For example, waste disposal providers may employ a lifting mechanism to lift and rotate a waste container over a trash receptacle of a garbage truck. To avoid the lid from preventing the contents of the bin from falling out of the bin and being dumped into the garage truck, the latch mechanism may be configured to automatically disengage from the release mechanism and permit the lid to rotate to an open position. In such an embodiment, the latch mechanism may be configured such that in certain predetermined angular dump orientations of the latch mechanism, gravity is operative to actuate portions of the latch mechanism to cause the latch mechanism to disengage from the release mechanism.

In general, both the hand operated release mechanism accessible from the outside of the lid and the automatic release features of the latch mechanism are capable of maintaining a lid in a closed position when the waste container is in an upright position and a human is not engaging the release mechanism. However, some animals (such as raccoons) working individually or in groups may be capable of discovering methods of opening a lid of a waste container in order to access discarded food therein. Thus, example embodiments of the latch mechanism and release mechanism described herein may be configured to require specific actions to operate that are not capable of being discovered and/or carried out by most raccoons.

For example, raccoons working together may be capable of pushing a waste container on its side, which causes the waste container and latch mechanism to rotate 90 degrees. Thus, to prevent the lid from opening in this possible situation, an example embodiment of a latch mechanism may be operative to prevent the lid from opening unless the waste container and latch mechanism has rotated to a range of predetermined angles (such as by more than 90 degrees) in which the opening is pointed somewhat downward enabling the container to be dumped. In this example embodiment, a dumping mechanism of a garbage truck may lift and rotate the waste container by 120 degrees or more, and thus the described latch mechanism would still be operative to automatically disengage the lid for this use. However, on flat ground, a raccoon is much less likely to be able to rotate a waste container more than 90 decrees by tipping it over. Thus, the lid would remain shut when tipped over by a raccoon.

An example latch mechanism that is operative in this described manner may include a latch housing, at least one latch slide bolt, and a release weight. The release weight may be operable to move responsive to gravity in at least a portion of the latch housing from a first position to a second position to cause the at least one latch slide bolt to move from an extended position to a retracted position relative to the latch housing.

A release mechanism for use with this described latch mechanism may include a release base, a release knob, and at least one release slide bolt. Operative movement of the release knob relative to the release base causes the release slide bolt to move from an extended position to a retracted position relative to the release base.

In this example embodiment, the latch mechanism is operatively configured to lockingly engage with the release mechanism when the at least one release slide bolt and the at least one latch slide bolt are in the respective extended positions and are in aligned engagement with each other (such as when mounted to a bin and lid of a waste container with the lid in a closed position). Also in this example embodiment, the latch mechanism is operatively configured to disengage from the release mechanism when the release weight has moved to the second position and has caused the at least one latch slide bolt to move to the retracted position so as to disengage from the at least one release slide bolt. In addition, in this example embodiment, the release mechanism is operatively configured to disengage from the latch mechanism when the release knob has moved relative to the release base from an extended position to a retracted position and then from a first angular orientation to a second angular orientation relative to the release base, to cause the at least one release slide bolt to move to the retracted position so as to disengage from the at least one latch slide bolt.

In an example embodiment, the latch mechanism includes a push member that is operable to slide in the latch housing from a first position to a second position responsive to the release weight sliding in at least a portion of the latch housing from the first position to the second position of the release weight. The latch mechanism may also include at least one drive member that is operable to rotate from a first angular position to a second angular position responsive to the push member sliding from the first position to the second position of the push member. The at least one drive member may include a projection that is operative to engage with the at least one latch slide bolt and cause the at least one latch slide bolt to move from the extended position to the retracted position responsive to the at least one drive member moving from the first angular position to the second angular position.

The latch housing and the release weight may be configured such that the push member and release weight are spaced apart when the release weight is in the first position of the release weight. When the latch mechanism is rotated, the release weight will slide at least some distance in the housing before contacting the push member.

In an example embodiment, the at least one slide bolt moves in directions that are transverse to the directions that the release weight and push member slide in the housing. For example, the slide bolt may move from the extended position to the retracted position along a first direction. Also, both the release weight and the push member may slide between the respective first positions to the respective second positions in a second direction. With this example, the first direction is generally perpendicular to the second direction. However, it should be appreciated that in other examples the first and second directions of travel among these elements may be orientated at other angles with respect to each other.

The described at least one latch slide bolt may correspond to the latch mechanism having two latch slide bolts that travel in opposite directions between their respective extended and retracted positions. In this example, at least one spring may be positioned between the two latch slide bolts. The at least one spring may be operative to urge the latch slide bolts to move in opposite directions toward their respective extended positions.

In addition, the described at least one drive member may correspond to the latch mechanism having two drive members. Each of the drive members may be operable to pivot with respect to a respective pivot axis. Also, each respective drive member is operable to engage with and cause a respective one of the two described latch slide bolts to move.

In this described example with two drive members and two latch slide bolts, the push member may include a channel bounded by two push arms on opposed sides of the channel. When the push member is in the second position, the pivot axis of each drive member may extend in the channel of the push member.

In addition, each drive member may include a driven edge surface that is substantially flat. When the push member moves from the first position to the second position of the push member, the push arms both push the respective drive members and slide along the respective driven edge surfaces of the drive members. Also, portions of the two push arms may include engaging surfaces that are substantially flat. In this configuration, when the push member is in the second position of the push member, the substantially flat surfaces of the drive members and the push arms may be substantially parallel to each and in contact with each other.

In example embodiments, the release mechanism may include a release receptacle in operative connection with the release base. The release receptacle may have outer walls that bound a cavity therein. The release slide bolts are positioned inside the cavity, such that when the latch mechanism is in latched engagement with the release mechanism, portions of the latch mechanism extend in the cavity of the release receptacle to enable the latch and release slide bolts to engage with each other.

To facilitate guiding portions of the latch mechanism that include the latch slide bolts into the cavity of the release receptacle, each of two opposed walls of the release receptacle may include a guide flange that extend outwardly from the release receptacle walls. Also to facilitate engagement of the latch and release slide bolts, the at least one release slide bolt may include an aperture. Thus, when the latch mechanism is in latched engagement with the release mechanism, the at least one latch slide bolt extends in the aperture of the at least one release slide bolt. However, it should be appreciated that in alternative embodiments, the latch slide bolt may include the aperture and the release slide bolt may extend in the aperture of the latch slide bolt.

It should also be noted that animals such as raccoons may be capable, through trial and error, of discovering ways to operate simple buttons or handles in order to manually open a latch mechanism of a waste container. Thus, example embodiments may employ a release mechanism that requires a combination of different manual operations and movement in two different directions to manually cause the described release mechanism to disengage from the described latch mechanism (when the waste container is in its upright—0 degree position).

For example, an embodiment of the release mechanism may include a movable release knob that requires the knob to be both pushed inwardly and then rotated in order to release the latch mechanism. In this example, the release mechanism may be mounted to the lid in a location such that the described release receptacle is operative to extend through an aperture in the lid and be aligned with a portion of the previously described latch mechanism (when the lid is pivoted to its closed position).

The release knob may be operative to move axially between an extended position and a retracted position relative to the release base. Also, a spring may bias the release knob to move to the extended position. When the release knob is in the retracted position, the release knob is enabled to rotate with respect to the release base. A further spring may bias the release knob to rotate the knob in the opposite direction.

In this described example, the release knob may include a cam surface that is operative to rotate with the turning of the release knob. When the release knob is in the retracted position and is rotated in a first angular direction, the cam surface may be operative to urge the at least one release slide bolt to move from the extended position to the retracted position. In examples where the release mechanism includes two release slide bolts, the cam surface may be positioned between portions of the slide bolts. As the knob is turned, the cam may urge the release slide bolts to move in opposite directions from their respective extended positions to their respective retracted positions (thus disengaging from the latch slide bolts of the latch mechanism). However, in this example, when the release knob is in the extended position relative to the release base, the release knob is not enabled to be rotated in a manner that causes the release slide bolts to move to the retracted position.

In this described embodiment, the release weight may be encapsulated inside the latch housing of the latch mechanism. Such a latch housing may then be mounted to an inside wall surface of the waste container. However, in a further embodiment, rather than fully encapsulating the release weight in the housing, the latch housing may instead include a partially open cavity therein in which the release weight is operable to slide. For example, the latch housing may include an opening adjacent at least one side of the release weight. Such an opening may facilitate moving the release weight into the cavity prior to installing the latch housing on the waste container. The latch housing may then be mounted to an inside surface of the waste container (via bolts or other fasteners) such that the inside wall surface of the waste container sealingly covers the opening in the latch housing.

Other aspects will be appreciated upon reading and understanding the attached figures and description.

DETAILED DESCRIPTION

Figure 1:
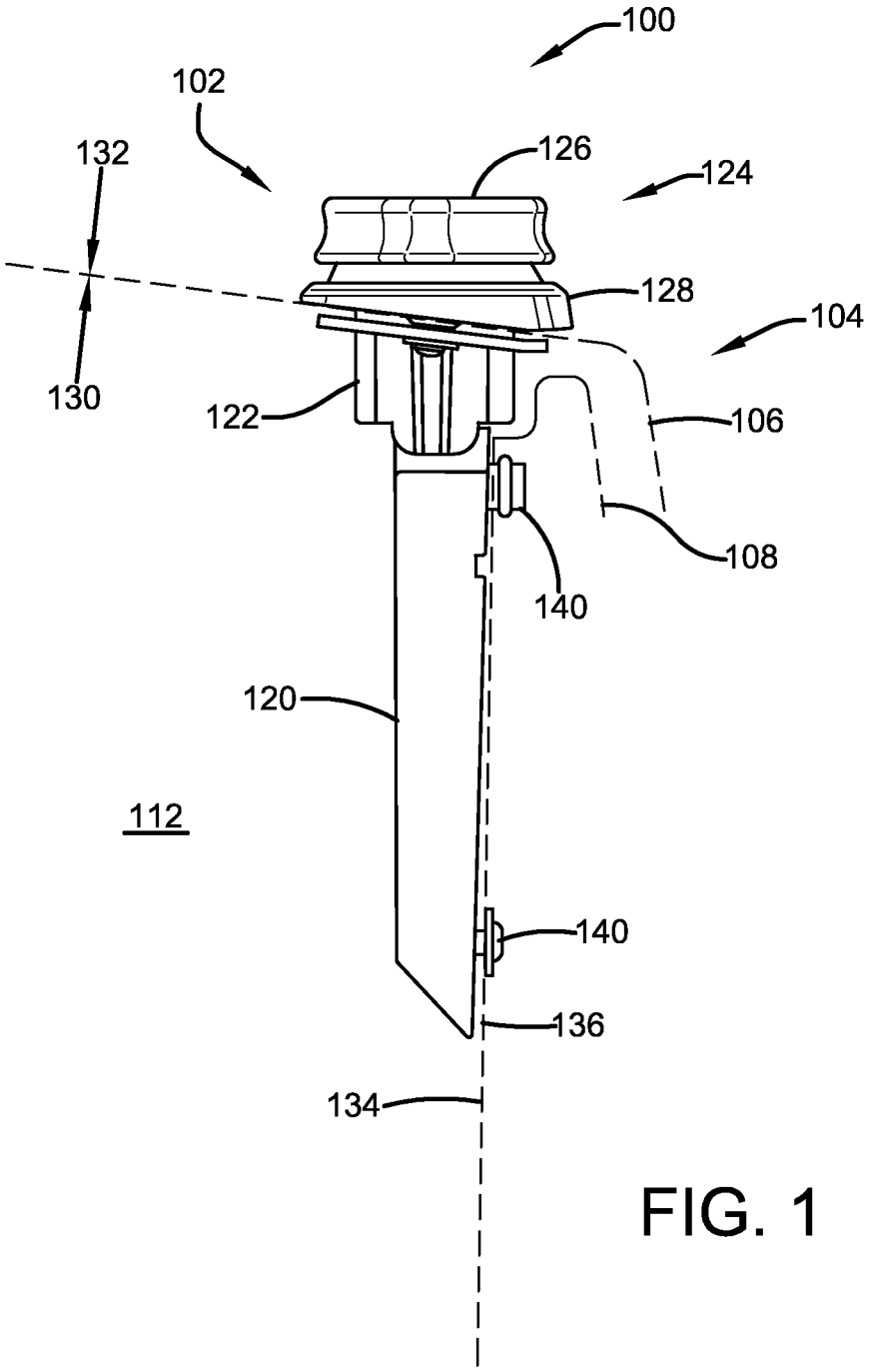
FIG. 1 is a side view of an example apparatus that facilitates latching and unlatching a lid in holding engagement with a bin of a waste container.

Various technologies pertaining to latch and release mechanisms for waste containers will now be described with reference to the drawings, where like reference numerals represent like elements throughout. In addition, the example systems are illustrated and described herein for purposes of explanation; however, it is to be understood that functionality that is described as being carried out by certain system components may be performed by multiple components. Similarly, for instance, a component may be configured to perform functionality that is described as being carried out by multiple components.

FIG. 1, is a side view 100 of an exemplary apparatus 102 that facilitates latching in holding engagement and unlatching a lid and a bin of waste container 104. Such a lid 106 may for example be in pivoting connection with the bin 108 of the waste container via one or more hinges. The lid may pivot from the closed position shown in phantom in FIG. 1 to an open position in which an opening to the cavity 112 inside the bin is accessible to load or unload articles (e.g., garbage/trash). The elements of the hinge (not shown in FIG. 1) may be integrally formed with the lid and waste container elements. However, it should be appreciated that in some embodiments hinge mechanisms may be fastened to the lid and bin of the waste container to enable the lid and bin to pivot with respect to each other.

In an example embodiment, the lid and bin of the waste container may be made of a plastic material such as a high density polyethylene (or other plastic such as a polypropylene) via a manufacturing process such as blow molding, injection molding, or other molding process. However, it should be appreciated that in alternative embodiments, the lid and bin of the waste container may be made out of other materials such as metal (e.g., aluminum or steel).

Of course it should be understood that while the example embodiment described herein includes a container with a hinged lid or cover, other embodiments may include different configurations. Such configurations may include multiple covers or closure members that are movable relative to one or more openings to open and close a cavity of the bin or other container. Other arrangements may include closure members that move relative to the bin, such as by sliding sideways relative to an opening. Still other arrangements may include lids or closure members that may move and be disengaged completely from the container. Such different configurations of waste containers may be utilized with latch and other structures including the features described herein.

Figure 2:
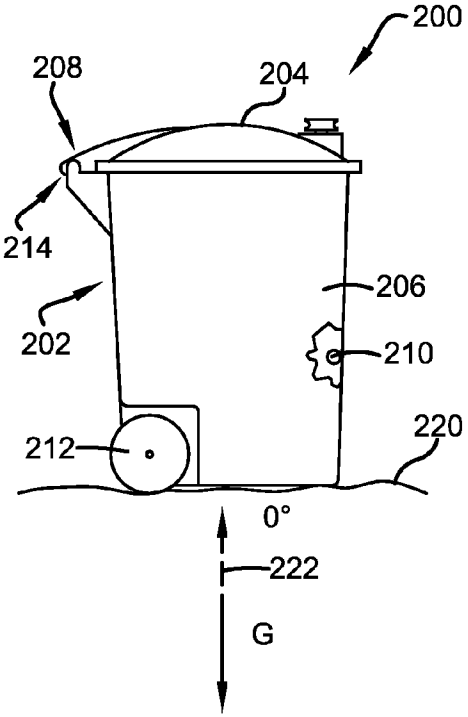

FIG. 2 is a side view 200 of an exemplary waste container 202 having a lid 204 and a bin 206, which is usable with the latch mechanisms described herein. The lid and bin may be coupled via hinge portions 208. In FIG. 2, the waste container is shown in an upright orientation 222 relative to the ground 220 and direction of gravitational force G with the top of the closed lid 204 facing upwardly. This upright orientation 222 corresponds to the waste container being rotated 0 degrees (i.e., it is not rotated from this upright position). In this upright position, the opening to the cavity of the example waste container extends generally horizontally. This upright orientation of the container is the common orientation of the container when waste is added and when storing waste.

In this example, the waste container 202 includes features that enable the waste container to be lifted, rotated and unloaded via a lifting mechanism of a dump truck or other unloading device. Such features, for example, may include a metal horizontal retention bar 210 coupled to exterior walls bounding an external recess of the bin. Such a waste container 202 may also include wheels 212 and a handle 214. In the U.S., such waste containers may be compatible with a standard such as ANSI Z245.60—2008, the disclosure of which is incorporated herein by reference in its entirety. Also, such waste containers may have different interior capacities such as 26 gallon, 32 gallon, 64 gallon, or 96 gallon sizes, or other waste container sizes. Thus, it should be appreciated that embodiments of the latch and release mechanisms described herein may be adapted for use with any type and/or configuration of a waste container that includes a lid.

Figure 4:
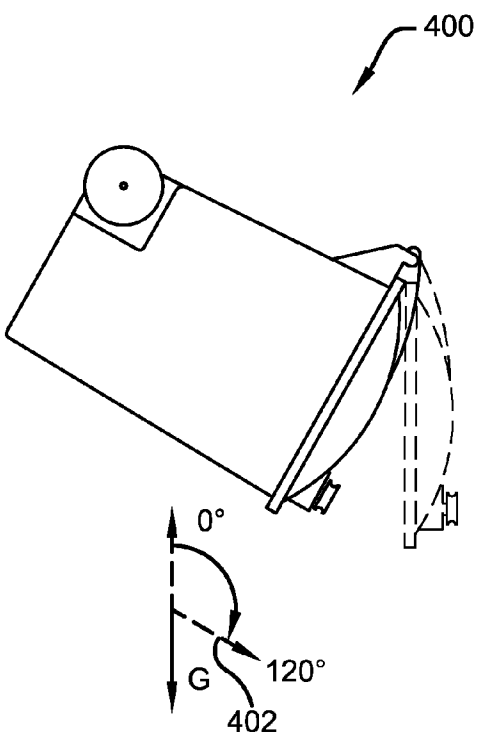
FIGS. 2-4 are side views of a waste container in different angular positions of rotation.
Figure 3:
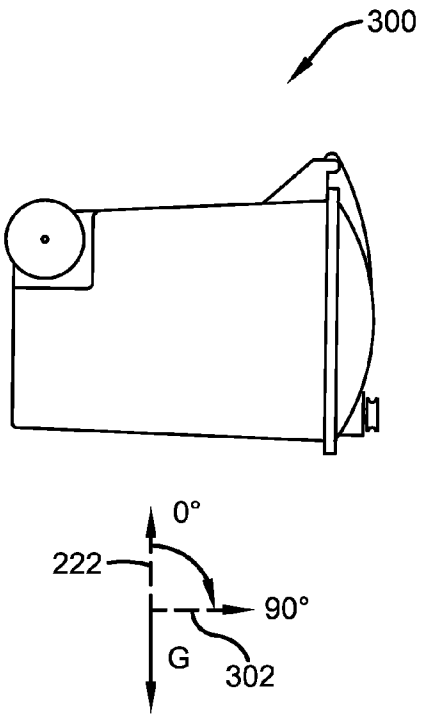

FIGS. 3 and 4 show example orientations of the waste container as it is being rotated for dumping by a lifting mechanism such as such a mechanism of a garbage truck (however, the lifting mechanism is not shown). In particular, FIG. 3 illustrates an example side view 300 of the waste container 202 in a rotated orientation relative to the ground 220 and direction of gravitation force G with the top of the closed lid 204 facing sideways. This sideways orientation 302 corresponds to the waste container being rotated 90 degrees from the upright orientation 222 shown in FIG. 2.

FIG. 4 illustrates an example side view 400 of the waste container 202 in a further rotated orientation relative to the ground 220 and direction of gravitation force G with the lid being enabled to rotate responsive to gravity away from its closed position to an open position. This downwardly angled orientation shown corresponds to the waste container being rotated about 120 degrees from the upright orientation 22 shown in FIG. 2. At this dump angle orientation (which in some arrangements may include a range of selected downwardly sloping angles), the lid automatically becomes unlatched (as will be described below in more detail) as the opening to the container is positioned downwardly to some extent to allow the contents of the waste container to be unloaded by being dumped out of the cavity.

Referring back to FIG. 1, the example apparatus 102 includes an exemplary latch mechanism 120, and an outside release mechanism 124. The latch mechanism is also referred to as a latch. When the lid 106 is in a closed position relative to the bin 108 and the waste container is in the upright position shown in FIG. 2, the latch may be operative to lockingly engage a release receptacle 122 of the release mechanism 124 to prevent the lid from pivoting to its open position. To enable the lid to open, the example release mechanism 124 is configured to be operated manually by a user in order to actuate portions of the latch that enable the latch to disengage from release mechanism.

The example outside release mechanism includes a movable element such as a knob 126. The knob may be in operative connection with a base 128. The base 128 has an outer shape that is compatible with the surface configuration of the lid 106. For example, as shown in FIG. 1, the outer surface of the lid 106 slopes downwardly in a closed position to an end of the lid. The exemplary base 128 is configured to mount to such a sloped surface while orientating the knob, and an axis of rotation of the knob about which the knob is rotatable, is substantially vertical when the container is in the upright orientation.

However, it should be appreciated that in alternative embodiments, the base may be configured to orientate the knob in other angular orientations and may be adapted to mount to lids of waste containers with other slopes and surface configurations. Also, in alternative embodiments of the outer release mechanism, rather than having a knob shape, at least one manually movable member may have the shape of a paddle, lever, button, handle, or any other configuration that is capable of being manipulated by a user to actuate the release mechanism. In exemplary arrangements the at least one manually movable member is moved in two different directions, either linear, rotational or a combination thereof to unlatch.

As shown in FIG. 1, the exemplary latch 120 is mounted in fixed operatively attached connection to inside surface 134 of a wall 136 of the bin 108. When the lid 106 is in a closed position, an inside surface 130 of the lid faces inwardly toward the cavity 112 and closes the opening, while an outside surface 132 of the lid faces outwardly. In this example, portions of the outside release mechanism including the knob 126 and release base 128 are mounted adjacent to the outside surface 132 of the lid, while other portions of the release mechanism, such as the release receptacle 122, are positioned adjacent and disposed inwardly of the inside surface 130 of the lid 106.

However, it should be appreciated that in alternative embodiments, these elements may have different configurations and may be mounted to the waste container in other orientations. For example, alternative embodiments of the latch 120 may be mounted to the lid 106, while the release mechanism is mounted to the side wall 136 of the bin. In order to mount these described elements to the waste container, the latch and outside release mechanism may include threaded bores and/or apertures to accommodate the use of fasteners 140 such as of bolts, screws, nuts (or any other type of fasteners or other devices that are operative to hold these elements to the waste container).

Figure 5:
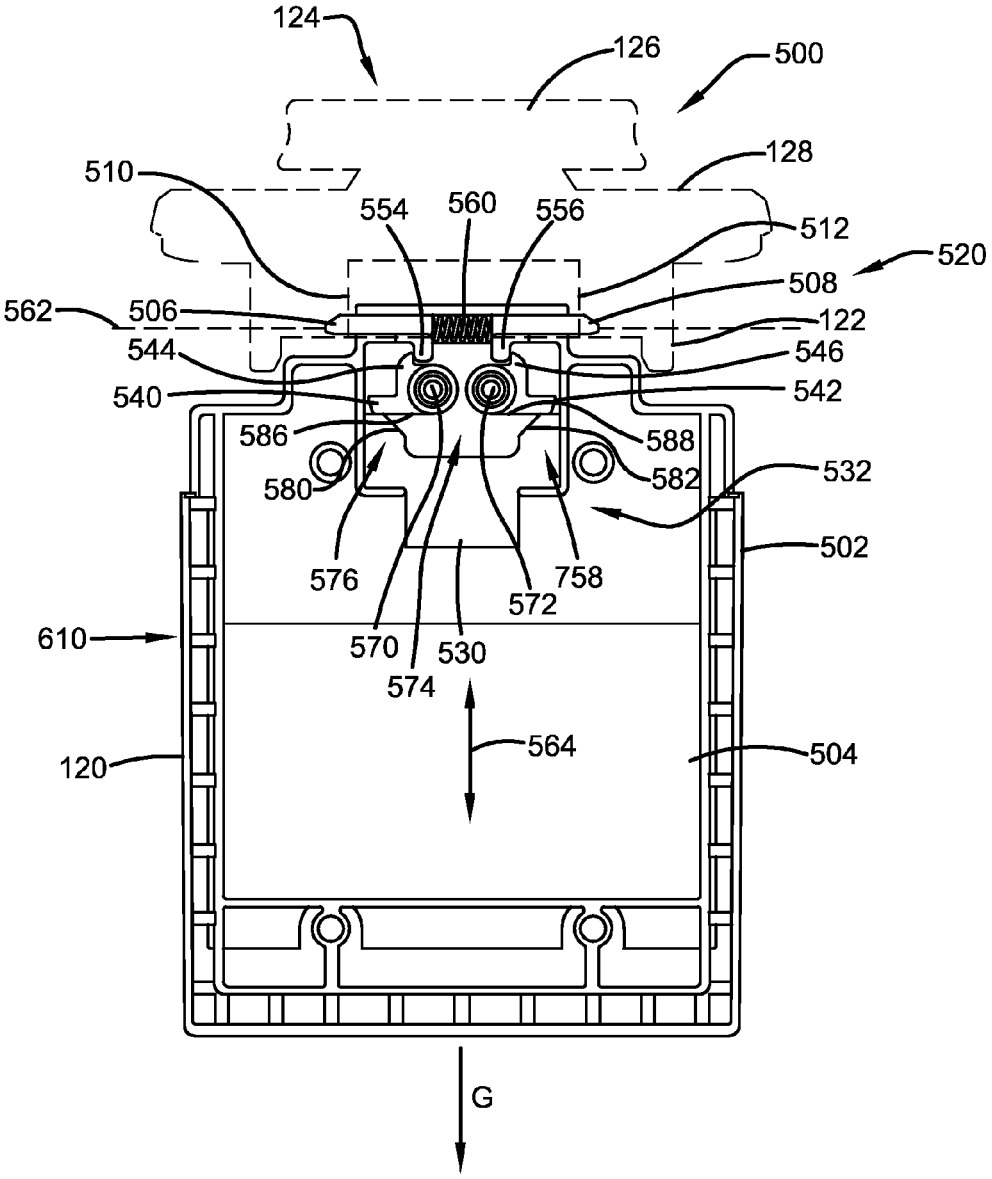
FIGS. 5-6 are cross-sectional views of the latch mechanism at different angular orientations.
Figure 6:
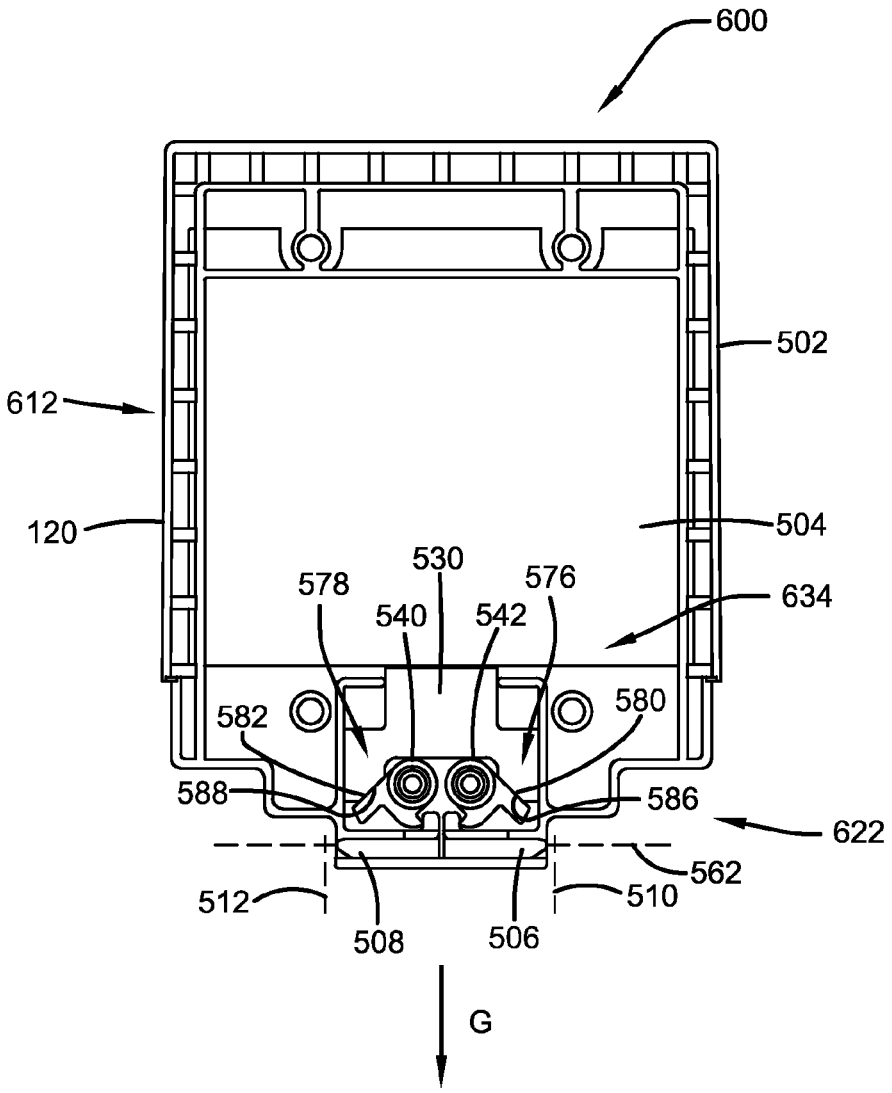

FIGS. 5 and 6 illustrate example operations of the exemplary latch 120. FIG. 5 shows a cross-sectional view 500 of the latch in a neutral configuration. Such a neutral configuration corresponds to an orientation of the internal elements of the exemplary latch when the waste container to which it is mounted in an upright (zero degree) orientation 222 with the lid latched closed (such as shown in FIG. 2). FIG. 6 shows a side cross-sectional view 600 of the latch in an internal release configuration. The internal release configuration corresponds to an orientation of the internal elements of the latch when the waste container to which it is mounted is rotated to the downwardly dump angular orientation 402 (e.g., 120 degrees or other downwardly sloped angle or range of angular orientation) in which the lid is enabled to open (such as shown in FIG. 4). Thus, the latch in FIG. 6 is shown being inverted compared to the orientation shown in FIG. 5.

With reference to FIGS. 5 and 6, the exemplary latch 120 includes a housing 502. Movably mounted in the housing is a release weight 504. In addition, the latch includes at least one latch slide bolt. For example, as shown in FIG. 5, the latch mechanism may include two latch slide bolts 506 and 508.

When the latch 120 is rotated from the neutral orientation shown in FIG. 5 to the inverted orientation shown in FIG. 6 which corresponds to the dump angular orientation, the release weight is operable to move responsive to gravity G from a first position 610 to a second position 612. The movement of the weight is operative to cause the latch slide bolts 506, 508 to each move from extended positions referred to as 520 to retracted positions referred to as 622 relative to the latch housing 502.

When the latch 120 is in the neutral orientation (shown in FIG. 5), the latch slide bolts 506, 508 in the extended positions are operable to engage and hold the release mechanism 124 (shown in phantom) in latched engagement. When the latch 120 is in the release orientation (shown in FIG. 6), the latch slide bolts 506, 508 move inwardly to the retracted positions so that the slide bolts can disengage from the release mechanism 124.

As will be described in more detail below, an example outside release mechanism 124 includes a release receptacle 122 that includes at least one movable release slide bolt. For example, as schematically illustrated in FIG. 5, the exemplary release mechanism includes two spaced apart release slide bolts 510, 512. Such release slide bolts are also operative to respectively move between inwardly extended and outwardly retracted positions. In FIGS. 5 and 6 the release slide bolts are shown in phantom in extended positions.

In this example, the latch is operatively configured to lockingly engage with the release mechanism when the latch slide bolts 506, 508 and the release slide bolts 510, 512 are all in their respective extended positions and are in aligned engagement with each other. As shown in FIG. 6, the latch is operatively configured to disengage from the release mechanism when the release weight 504 has moved to the second position 612 and has caused the latch slide bolts 506, 508, to move to their retracted positions 522 so as to disengage from the release slide bolts 510, 512. Also, as will be explained in more detail below, the release mechanism 124 is operatively configured to disengage from the latch mechanism when the release knob 126 is manually moved relative to the release base 128 in two directions to cause the release slide bolts 510, 512 to move to retracted positions (e.g., becoming further spread apart) so as to disengage from the extended latch slide bolts 506, 508.

In an example embodiment, the latch includes a push member 530 that is operable to slide in the latch housing 502 from a first position 532 (shown in FIG. 5) to a second position 634 (shown in FIG. 6). The push member is configured to move responsive to the release weight 504 sliding in the latch housing from the first position 610 to the second position 612 of the release weight.

Also, in this described example, the latch includes at least one drive member. For example, as shown in FIGS. 5 and 6, the latch includes two drive members 540, 542. These drive members are each operable to rotate about a respective spaced apart drive member axis of rotation between first angular positions (shown in FIG. 5) to second angular positions (shown in FIG. 6) responsive to the push member moving from the first position 532 to the second position 634 of the push member.

The exemplary drive members include respective projections 544, 546 that are respectively operative to engage with corresponding projections 554, 556 of the respective latch slide bolts 506, 508. The latch slide bolts are caused to move from their extended positions 520 (shown in FIG. 5) to their retracted positions 622 (shown in FIG. 6) responsive to the respective drive members 540, 542 moving from their first angular positions to their second angular positions.

In this described embodiment, the latch includes at least one spring 560 (e.g., a compression spring) that acts between the two latch slide bolts 506, 508. The spring is operable to urge the latch slide bolts in opposite directions to move them outwardly toward their extended positions 520. When the release weight 502 and push member 530 have returned to their respective first positions (as shown in FIG. 5), the latch slide bolts are biased toward the extended positions, but are enabled to be movable inwardly. In the exemplary arrangement the latch slide bolts are enabled to move inwardly so as to move into engagement with the release slide bolts as the latch slide bolts and release slide bolts move transversely toward the aligned position in which the latch and release slide bolts engage one another in holding engagement.

In the arrangement shown in FIGS. 5 and 6, the latch slide bolts move between their extended and retracted positions along a first common direction 562. Also, both the release weight and the push member move between their respective first and second positions along a second common direction 564. In this described embodiment, these direction 562 and 564 are orientated generally perpendicular to each other. However, it should be appreciated that in alternative embodiments, these directions of motion may be orientated at other transverse angles with respect to each other.

To enable the exemplary latch to operate with these two described perpendicular directions of motion, the push member is operative to simultaneously actuate both drive members when moved from its first position 532 to the second position 634. For example, each of the drive members is operable to pivot with respect to a respective pivot axis 570, 572. Also, the push member includes a generally "y-shape" configuration that includes a channel 574 bounded by two push arms 576, 578 on opposed side ends of the push member. As the push member moves between the first and second positions 532, 634, the pivot axes 570, 572 extend within the channel 574 of the push member.

Also, as illustrated in FIGS. 5 and 6, the exemplary drive members 540, 542 each include driven cam follower edge surfaces 586, 588 that are substantially flat. Thus, when the push member 530 moves from the first position 532 to the second position 634 of the push member, the cam surfaces bounding the push arms 576, 578 both push the respective drive members and slide in engagement with the respective driven edge surfaces of the drive members. In addition, as shown in FIGS. 5 and 6, portions of the two push arms include angled engaging cam surfaces 580, 582 that are substantially flat and of a minor image configuration. Thus, when the push member 530 is in the second position 634 (shown in FIG. 6), the substantially flat edge cam surfaces 586, 588 of the drive members and the engaging cam follower surfaces 580, 582 of the push arms are substantially parallel to and in contact with each other. As can be appreciated from FIG. 6, the orientation of the exemplary cam surfaces of the push member and cam follower surfaces of the exemplary drive members are operative to effectively limit the movement of the push member so as to move the latch slide bolts to a desired retracted position. This is because the surfaces bounding the channel and cam follower surfaces engage the drive members so as to prevent further movement of the push member once the drive members have rotated the desired amount such that the respective flat follower surfaces of the drive members and the cam surfaces of the push members are fully in parallel engagement. This limiting effect on movement of the push member to the second position assures that the latch slide bolts are not retracted beyond a given distance, which might cause damage to the latch components, including for example, deformation of engaging surfaces or attempts to compress the spring 540 below its solid height. Of course it should be understood that these configurations are exemplary, and in other arrangements other approaches may be used.

In addition, as shown in FIG. 5, when the exemplary latch is in its neutral orientation with the release weight 504 in its first position 510, the housing has sufficient length to enable the push member 530 to be spaced away from the release weight 504. Thus, when the latch is inverted due to the waste container being moved to a dump angle orientation (such as shown in FIG. 6), there is a delay from the time the release weight 504 begins moving responsive to gravity and the time the release weight engages and begins pushing on the push member 530. Such a delay is larger when the latch mechanism is only slightly sloped downwardly (such as when the angle of the container is at an angle of 100 degrees from horizontal) compared to being completely inverted (e.g., rotated 180 degrees).

In addition, it should be noted that the spring 560 will provide some resistance to movement of the push member and may be operative to prevent the release weight 504 from moving to the second position when the latch mechanism is only slightly angled downwardly as well (such as at an angle of 100 degrees). Consequently, when a waste container (with the example latch mounted thereto) is knocked over to the sideways orientation shown in FIG. 3 (e.g., a 90 degree angle of rotation), this described delay may be sufficient to enable jarring forces to dissipate by engagement of the weight and the side walls bounding the interior of the latch housing in which the weight is constrained to move. This configuration can often avoid such jarring forces causing the release weight 504 to move all the way to the second position 612 due to impact forces and/or to move to the second position with sufficient momentum to enable the lid of the waste container to become unlatched.

With this described exemplary configuration, the latch enables the lid to be automatically opened when a lifting mechanism of a garbage truck (or other device) lifts and rotates the waste container to a downward dump angular orientation between the sideways angular orientation shown in FIG. 3 (e.g., 90 degrees) and the downwardly sloped angular orientation shown in FIG. 4 (e.g., 120 degrees) or another angle or range of angles where the opening is directed downwardly sufficient for the contents of the cavity to be dumped out of the container. Whereas, if an animal such as a raccoon merely knocks the waste container on its side (as shown in FIG. 3) the lid of the waste container is likely to remain latched and closed.

As discussed previously with respect to FIG. 1, example embodiments of the described apparatus may include an outside release mechanism 124. Such a release mechanism enables a user to disengage the release mechanism from the latch so as to permit the lid to pivot to an open position when the waste container is in an upright orientation (such as shown in FIG. 2). This would be commonly done to add waste into the internal cavity.

Figure 9:
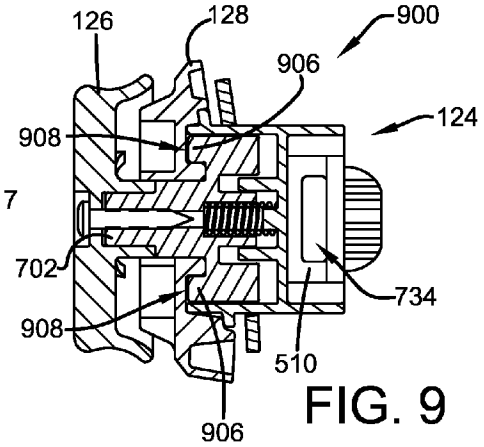
FIGS. 7-15 are cross-sectional and top views of a release mechanism for different configurations of the elements of the example release mechanism.
Figure 8:
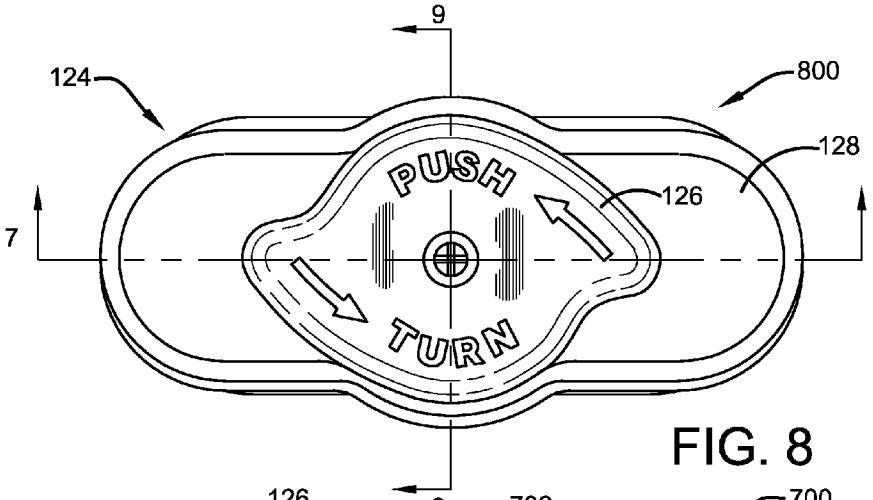
Figure 7:
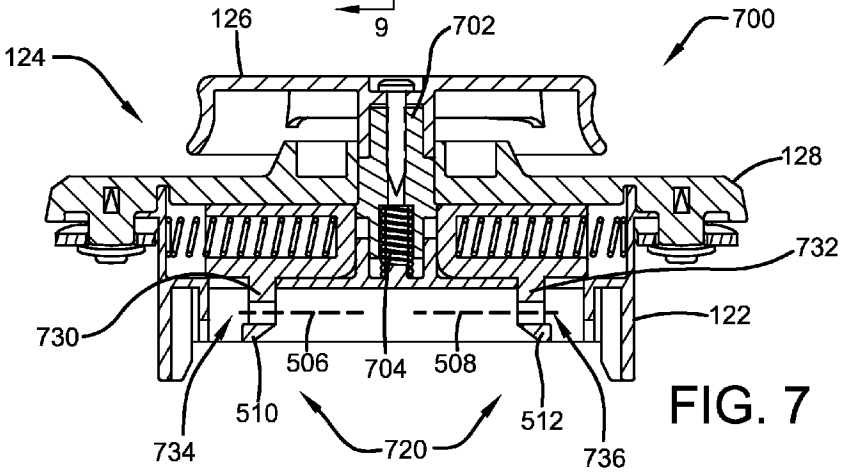

FIGS. 7-15 illustrate operations of the example release mechanism 124. FIGS. 7, 8, and 9 are respectively a front cross-sectional view 700, a top view 800, and a side cross-sectional view 900 of the release mechanism in a neutral configuration. As used herein, the neutral configuration corresponds to an orientation of the elements of the release mechanism when the release mechanism is not being manipulated by a human to disengage the release mechanism from the latch mechanism.

Figure 12:
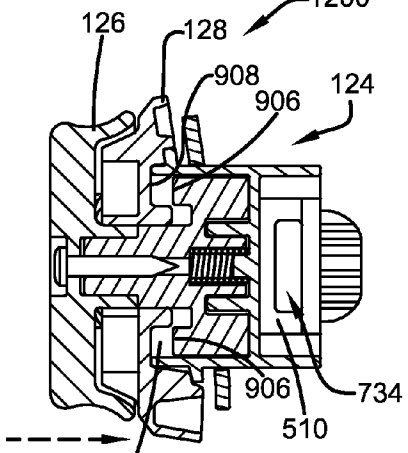
Figure 11:
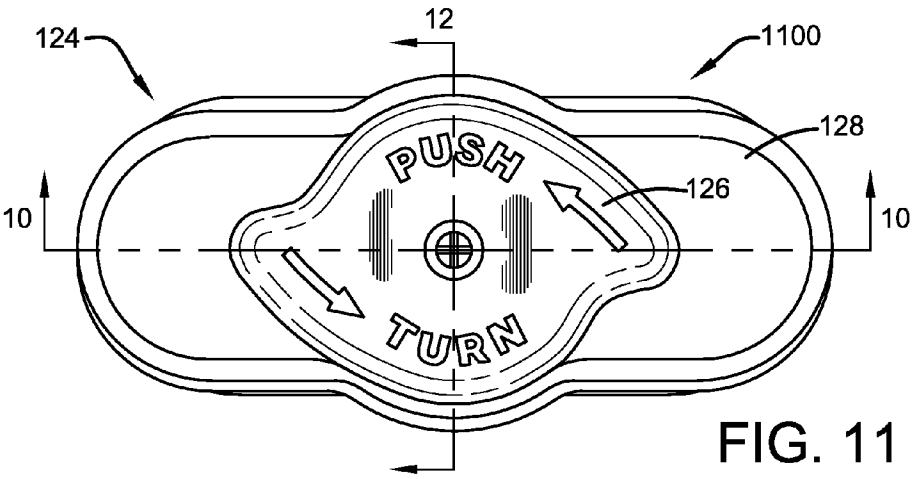
Figure 10:
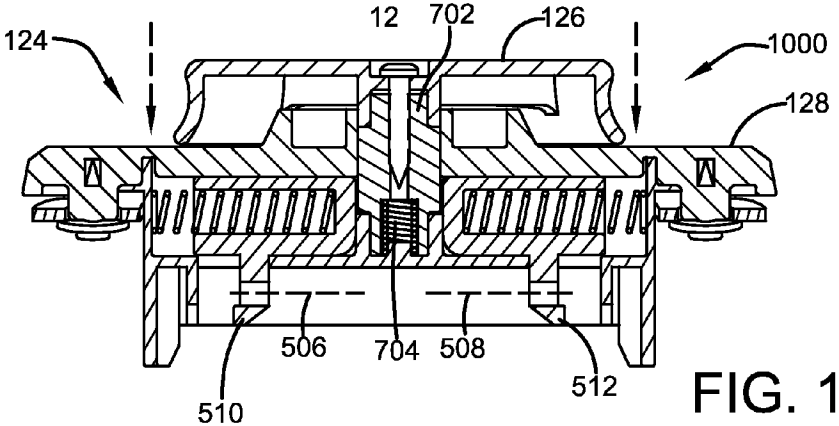

FIGS. 10, 11, and 12 are respectively a front cross-sectional view 1000, a top view 1100, and a side cross-sectional view 1200 of the release mechanism in an intermediate release configuration after the knob 126 has been pushed axially inwardly toward the base by a human (to be relatively more compacted in combination with the base 128).

Figure 15:
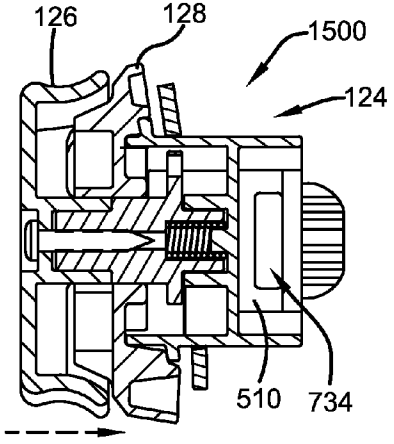
Figure 14:
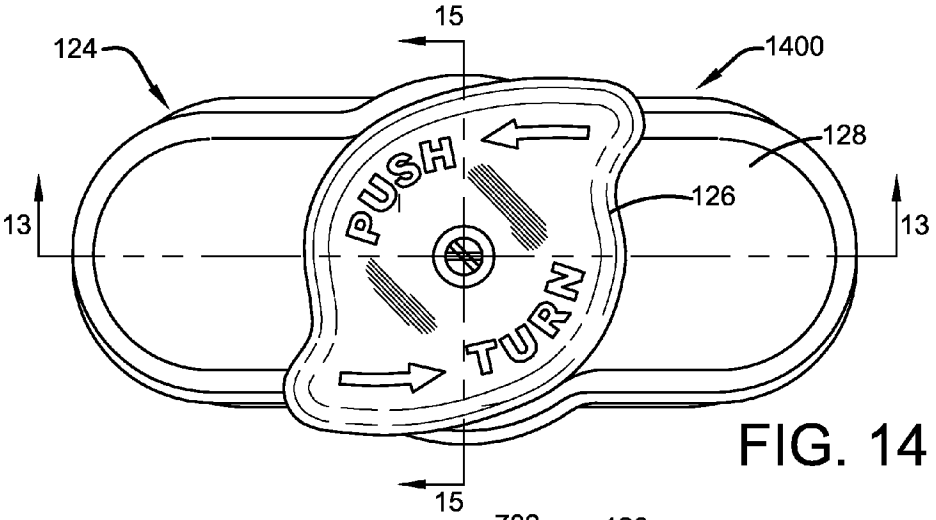
Figure 13:
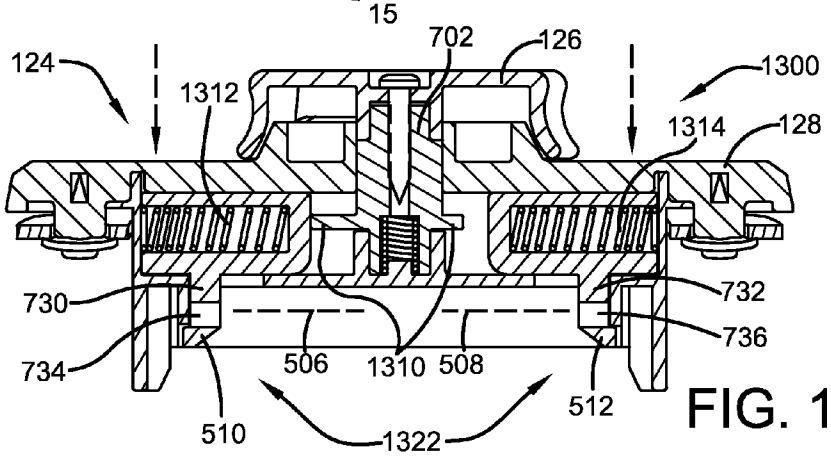

FIGS. 13, 14, and 15 are respectively a front cross-sectional view 1300, a top view 1400, and a side cross-sectional view 1500 of the release mechanism in a release configuration when the knob 126 is both pushed axially inwardly and is rotated with respect to the base 128. As used herein, the release configuration corresponds to an orientation of the elements of the release mechanism when the release mechanism is enabled to become disengaged from the latch due to movement of the knob.

Referring now to FIG. 7, the knob 126 of the release mechanism 124 is in operative connection with a shaft 702 that extends in a cavity in the base 128. A compression spring 704 is arranged to act operatively between portions of the shaft 702 and the base 128 so as to urge the shaft 702 and knob 126 to an outward extended position relative to the base 124. As shown in FIG. 9, when the knob is in the extended position, projections 906 on the shaft 702 are engaged in apertures 908 in the wall portion of the release base to prevent the knob from rotating.

Referring now to FIG. 12, when the knob 126 (and shaft) is moved inwardly to a retracted position relative to the base 128, the projections 906 in the shaft 702 move inwardly and are disposed from the apertures 908. Thus, in the intermediate orientation shown in FIGS. 10-12, the knob is free to either move back to the extended position (via the urging forces of the spring 704) or be rotated while in the retracted position.

As shown in FIG. 13, the exemplary shaft 702 is in integral operative connection with a cam 1310. Thus, when the knob 126 is rotated as shown in FIGS. 13-15, the cam 1310 is operative to urge the previously described release slide bolts 510, 512 to move laterally away from each other. Thus, the release slide bolts move from the respective extended positions 720 shown in FIG. 7 to the respective retracted positions 1322 shown in FIG. 13. Springs 1312 and 1314 are compression springs that are operative to provide biasing forces that bias the release slide bolts toward one another and that resist movement of the release slide bolts toward the retracted positions. Also in the exemplary arrangement, the springs 1312, 1314 enable the release slide bolts to move outwardly during movement into latched engaged relation with the latch slide bolts.

Figure 16:
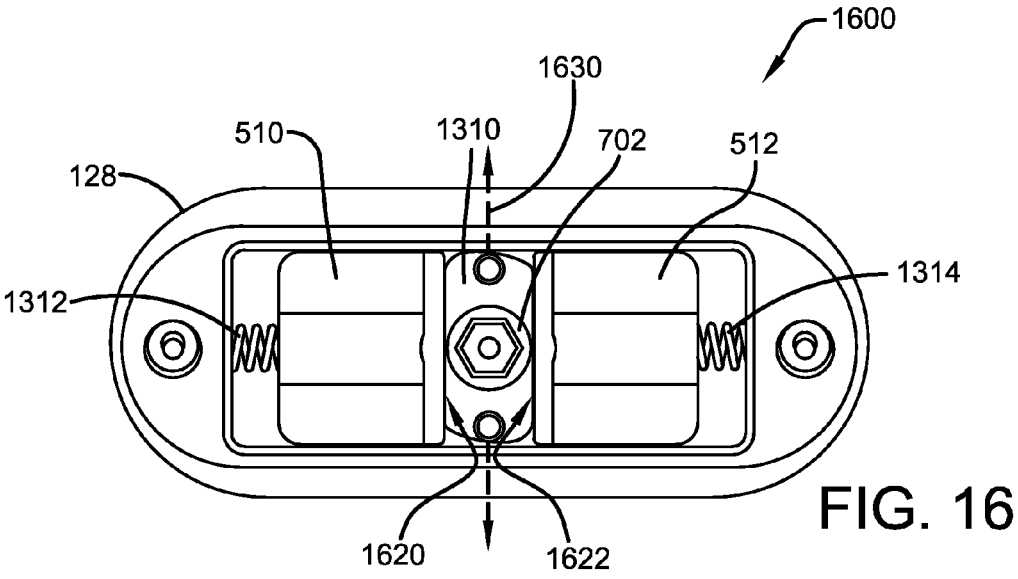
FIGS. 16-17 are top internal views of portions of the example release mechanism
Figure 17:
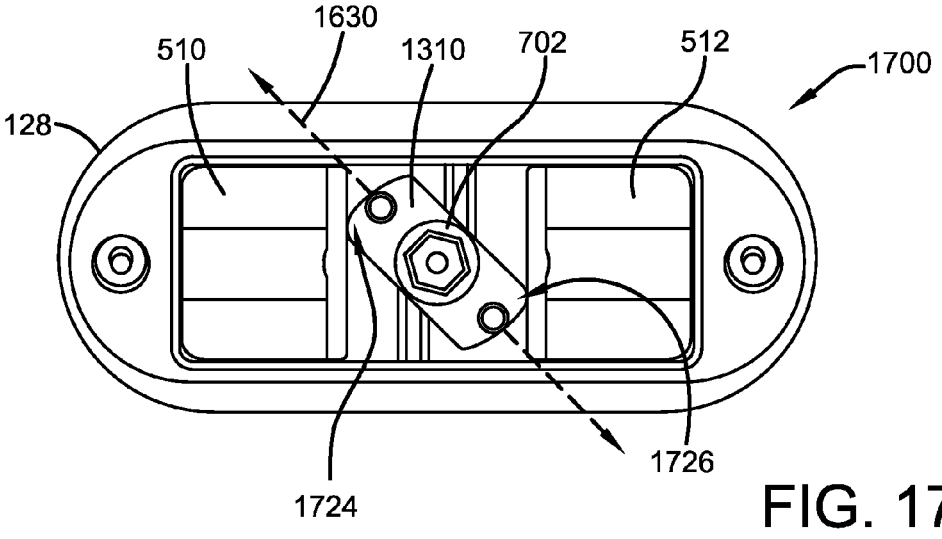

To illustrate the cam 1310 more clearly, FIGS. 16 and 17 are top internal views 1600, 1700 of the base 124 and shaft 702 (with the knob and an outer shell covering of the base both removed). In this example, the cam 1310 may correspond to two projections 1724, 1726 that extend radially from opposite sides of the shaft 702. FIG. 16 depicts the release mechanism 124 in the previously described neutral orientation such as shown in FIGS. 7-9. Here a longitudinal line 1630 that extends centrally through the two projections is orientated parallel to driven edge surfaces 1620, 1622 of the release slide bolts 510, 512.

FIG. 17 depicts the release mechanism 124 in the previously described release orientation such as shown in FIGS. 13-15. Here the longitudinal line 1630 of the projections has rotated (with the rotation of the knob). As a result, the projections 1724, 1726 have moved rotationally and have moved the driven edge surfaces 1620, 1622 of the release slide bolts 506, 508 in opposite directions away from one another outwardly to their retracted positions.

As discussed previously, hand operation of the exemplary knob is operative to enable disengagement of the outside release mechanism from the previously described latch. FIGS. 7 and 13 schematically show the previously described latch slide bolts and release slide bolts to illustrate the engagement and disengagement of these elements. As shown in FIG. 7, each exemplary release slide bolt includes a respective projection 730, 732. The projections extend downwardly in the upright orientation of the waste container and are accessible inside the receptacle 122 of the release mechanism. These projections include respective apertures 734, 736 which are configured to accept respective latch slide bolts 506, 508 in engaged relation. When all of the latch and release slide bolts are in their respective extended positions, and are in aligned engagement, the outward ends of each latch slide bolt extends in an aperture of a release slide bolt. Thus, in the arrangement shown in FIG. 7, the release mechanism is in holding latched engagement with the latch.

FIG. 13 shows the release slide bolts (and their respective projections 730, 732 and apertures 734, 736) in their respective outwardly retracted positions. In these positions the projections which include the apertures have moved outwardly away from the latch slide bolts 506, 508. As a result in this configuration, the latch slide bolts no longer extend into the apertures 734, 736 of the release slide bolts. Thus, in the position shown in FIG. 13, the release mechanism is no longer in holding engagement with the latch and the components are enabled to be disengaged.

In addition, it should be appreciated that when a person lets go of the exemplary knob after the knob has been rotated to the position shown in FIGS. 13-15, the springs 1312, 1347 are operative to automatically rotate the shaft 702 and knob 126 to the position shown in FIGS. 10-12. When the knob and shaft are in the position shown in FIG. 10-12, the previously described spring 704 is operative to urge the shaft and knob to move from the retracted position back to the extended position. Thus, when a person is done manually operating the release mechanism in the manner described, the release mechanism is operative to re-configure itself back to the neutral orientation shown in FIGS. 7-9. This assures that movement in two different directions is again required to enable disengagement of the latch.

Figure 18:
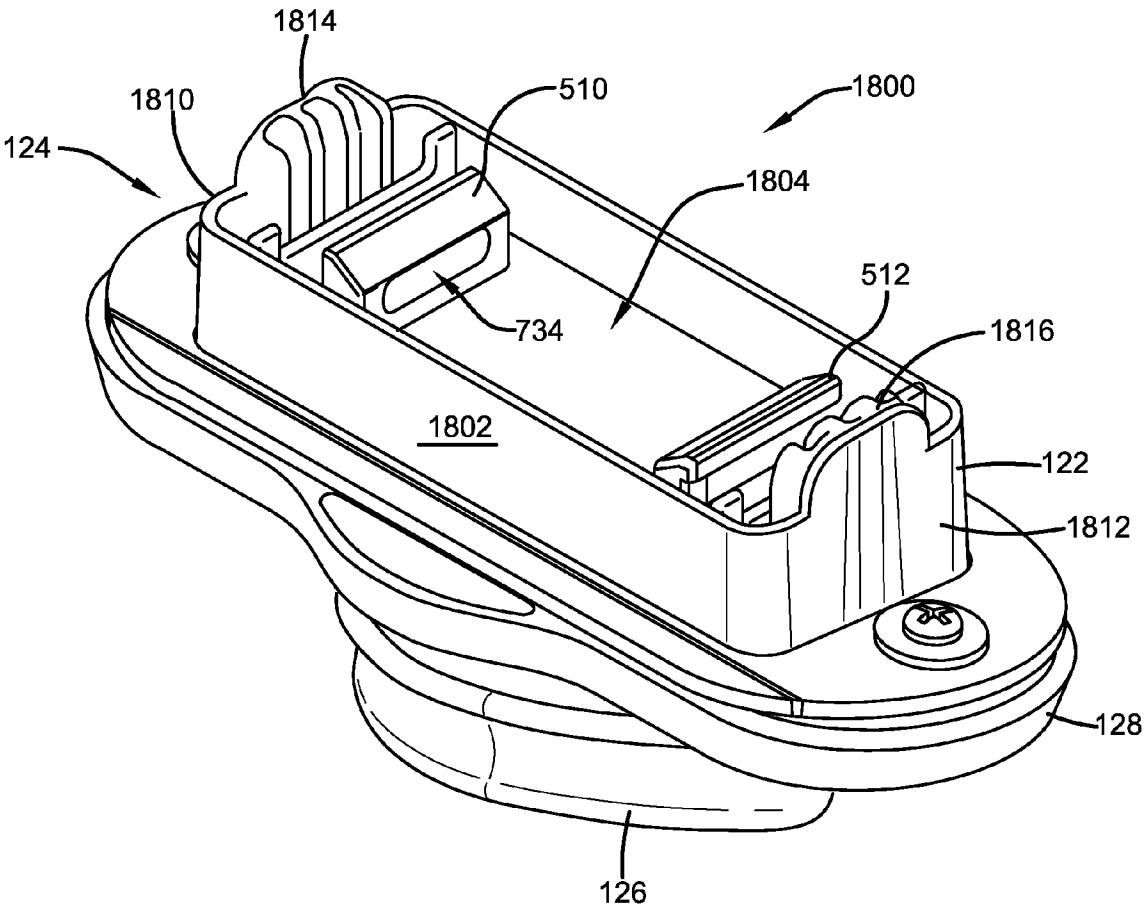
FIG. 18 is a bottom perspective view of the release mechanism.

FIG. 18 shows a bottom perspective view 1800 of the outside release mechanism 124 so as to more clearly show an example configuration of the release receptacle 122 and release slide bolts 510, 512. In this example embodiment, release receptacle has outer walls 1802 that bound a cavity 1804 therein. The two release slide bolts 510, 512 extend in this cavity.

To aid in the alignment of the release mechanism with the latch mechanism, the two opposed side walls 1810, 1812 of the release receptacle 122 include respective guide flanges 1814, 1816. Inwardly facing surfaces of the exemplary guide flanges may be at least partially curved/beveled in order to facilitate guiding portions of the latch that include the latch slide bolts into aligned engagement of the cavity of the release receptacle.

Figure 19:
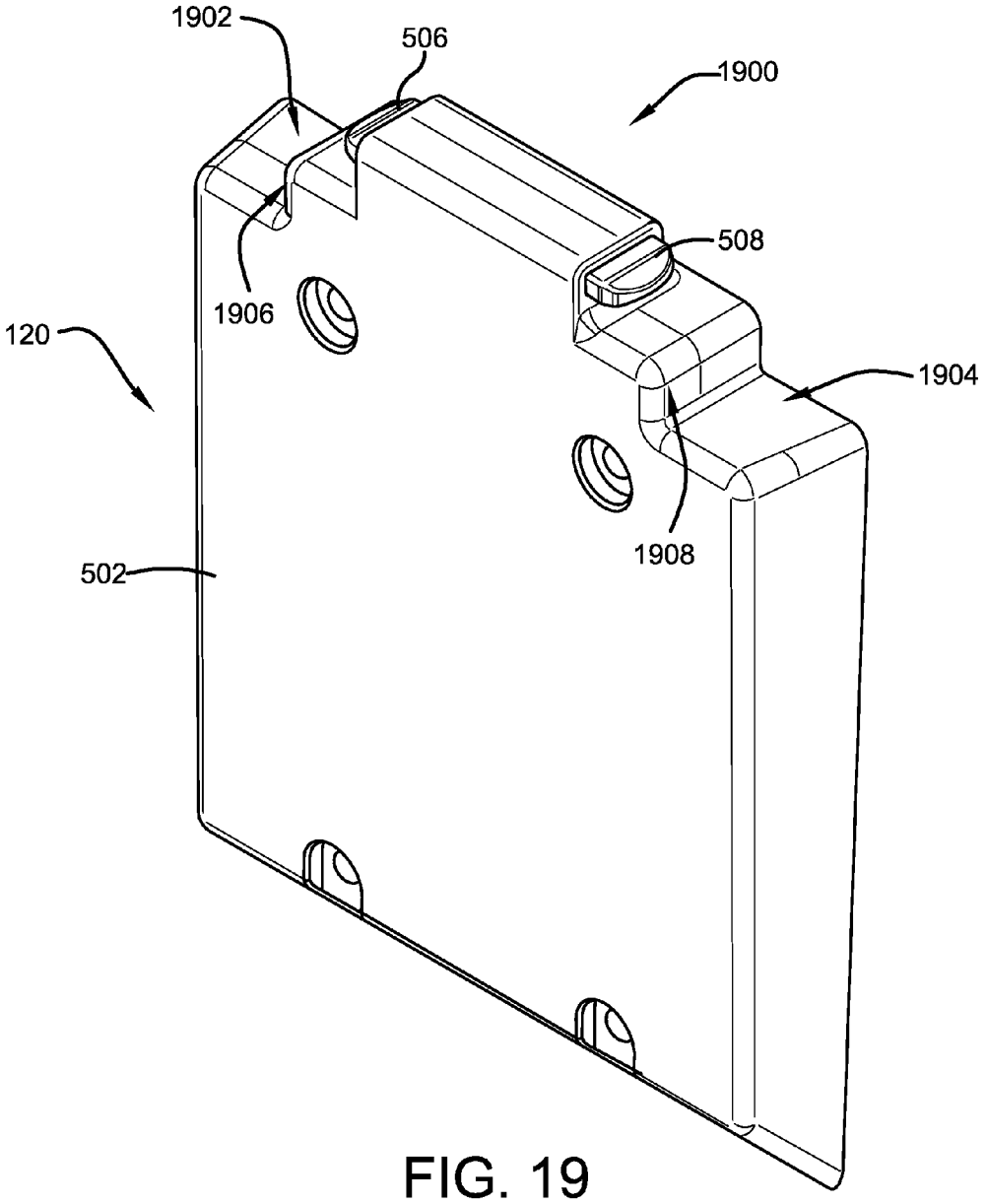
FIG. 19 is a top perspective view of the example latch mechanism.

FIG. 19 is a top perspective view 1900 of the latch 120 and more clearly shows an example configuration of the latch slide bolts 506, 508. To further aid in the alignment of these elements, the housing 502 of the latch mechanism includes corner channels generally indicated 1902, 1904 that are configured to receive the guide flanges 1814, 1816 of the release receptacle 122. Such channels 1902, 1904 may be partially bounded inwardly by opposed side walls 1906, 1908 that include curved/beveled surfaces.

Figure 20:
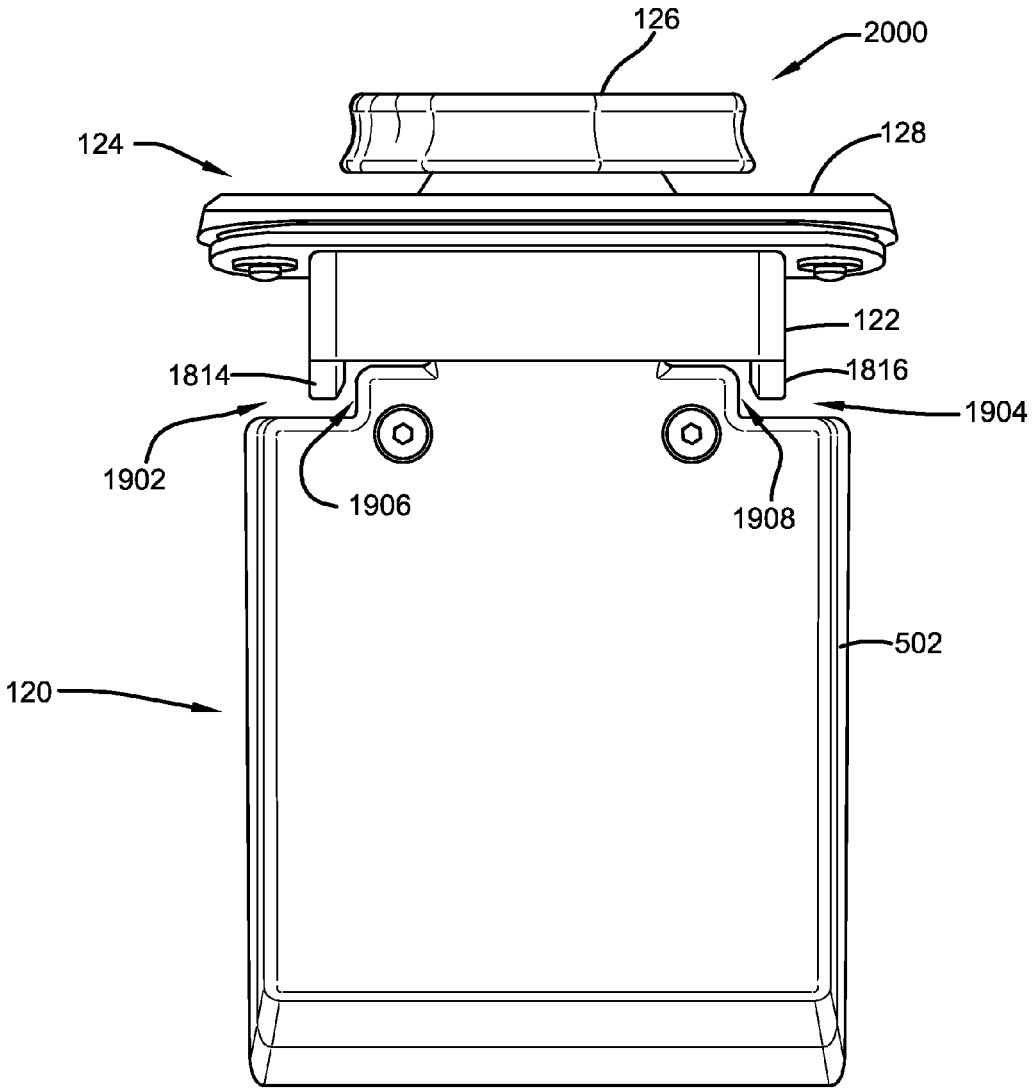
FIG. 20 is a front view of the release mechanism engaged with the latch mechanism.

For example, FIG. 20 is an example front view 2000 of the previously described latch 120 in engagement with the release mechanism 124. When the latch and release mechanism are brought together (e.g., with the closing of the lid of a waste container), such curved/beveled surfaces of the guide flanges and latch housing walls are operable to align these elements to ensure that the latch slide bolts engage with the release slide bolts in the cavity of the release receptacle 122.

In the examples of the latch and outside release mechanism described herein, when in engagement, the projections of the release slide bolts are configured to be more widely spaced apart than the spacing between the latch slide bolts. Thus, when engaged together, the latch slide bolts are positioned generally between the projections of the release slide bolts (except for the portions of the latch slide bolts extending in the apertures of the release slide bolts). However, it should be appreciated that in alternative embodiments, the configurations of these slide bolts may be reversed, with the release slide bolts generally being positioned to extend between projections associated with the latch slide bolts.

Also, other permutations and configurations are possible in further example embodiments. For example, the latch slide bolts may include apertures and the release slide bolts may extend into the apertures of the latch slide bolts. Also, in other embodiments, the release receptacle which includes the release slide bolts may instead be integrated into the latch as a receptacle with walls that surround the latch slide bolts.

It should be noted that in alternative embodiments, the described release mechanism may also be used for waste containers that do not include the previously described gravity operated latch mechanism. Rather, in place of the latch mechanism, the waste container may include a striker that includes projections operative to engage with the release slide bolts described previously.

Figure 21:
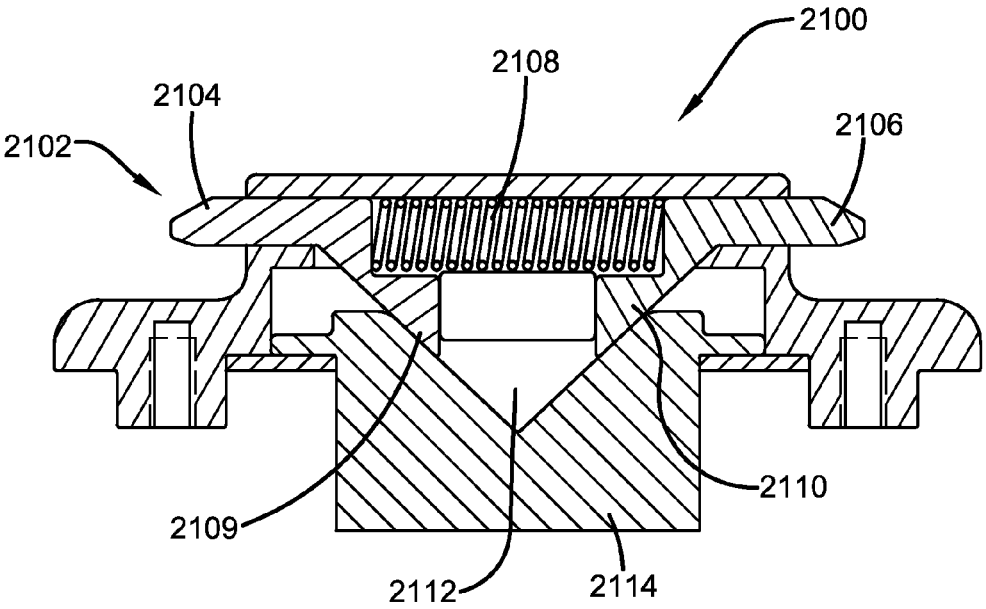
FIG. 21 is a cross-sectional view of an exemplary striker/release button mechanism.

Also, it should be appreciated that such a striker may include additional release features, such as a button that is operative to move the striker projections. FIG. 21 is cross-sectional view 2100 of such an exemplary striker/release button mechanism 2102. In this example, the described projections (which are configured to engage with the release slide bolts) correspond to striker slide bolts 2104, 2106 with a spring 2108 therebetween that is operative to urge the striker slide bolts to respective extended positions. Such striker slide bolts may include angled projections 2109, 2110 that extend into a triangularly shaped cavity 2112 of a push button 2114.

When the push button 2114 is pushed inwardly (e.g., upwards in FIG. 21), the angled surfaces of the cavity 2112 serve as cam surfaces that urge the striker slide bolts to retracted positions. In the retracted positions, the striker is operative to disengage from the release slide bolts of the outside release mechanism described previously.

In an example embodiment of a waste container in an upright orientation, such a striker/release button mechanism 2102 may be mounted in a manner that enables the outer surface of the button to extend in or to be accessible through an aperture in a horizontally orientated wall portion of the bin. In an exemplary location the button 2114 may face downwardly on the outside of the bin while the striker slide bolts face upwardly and outwardly under the lid to engage a release mechanism mounted to the lid. A flange area including an angular cavity enables mounting of the release button to the bin and movement of the button relative thereto. Rather than using gravity, this described striker/release button mechanism 2102 may require the lifting mechanism of a garbage truck (or a human operator of a garage truck) to depress the button 2114 in order to release the lid prior to dumping the contents of the waste container. This may be done in some arrangements manually before the container is lifted. Alternatively, the lifting mechanism may include a moving member that causes the button to be depressed when the container is in a dump angular orientation when the opening is pointed sufficiently downward to dump the contents.

In example embodiments, the described components of the latch mechanism, release mechanism, and striker/release button mechanism may be comprised of plastics (e.g., Polycarbonate, ABS, PVC), metals (stainless steel, aluminum, tin), and/or any other materials that are operative to form the shapes and be capable of carrying out the functions described herein. Further, these described elements may be mounted together with fasteners such as screws, bolts, adhesives, or any other fastening or bonding system applicable to the type of materials being assembled. In addition, it should be appreciated that the housings may include gaskets, o-rings, and/or other elements to increase the weather/water resistance of the described mechanisms.

Figure 22:
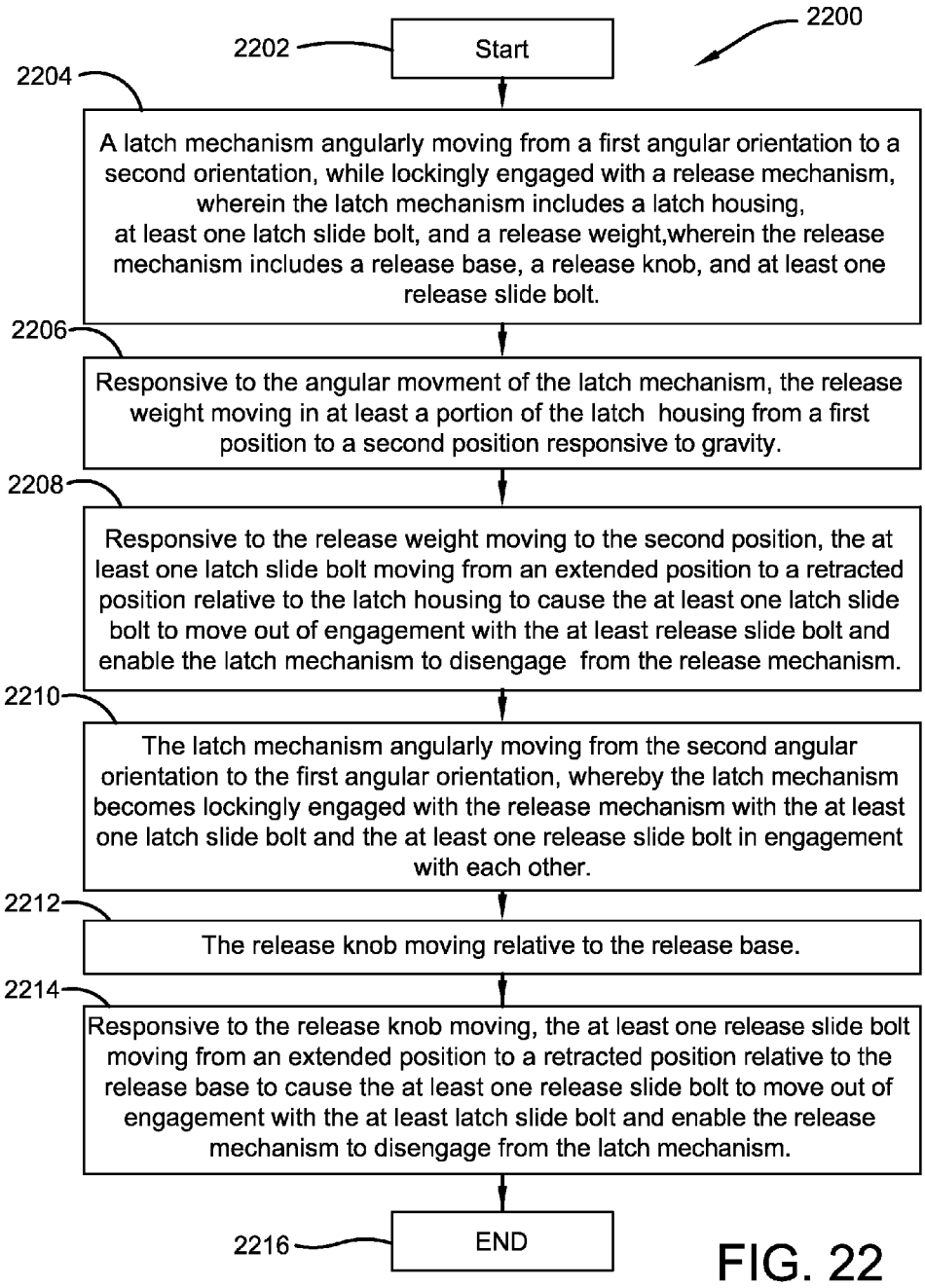
FIG. 22 illustrates an example methodology for the operation of an example latch and release mechanism of a waste container.

With reference now to FIG. 22, an example methodology is illustrated and described for engaging/disengaging the exemplary latch and release mechanisms of FIGS. 1-20. While the methodologies are described as being a series of acts that are performed in a sequence, it is to be understood that the methodologies are not limited by the order of the sequence. For instance, some acts may occur in a different order than what is described herein. In addition, an act may occur concurrently with another act. Furthermore, in some instances, not all acts may be required to implement a methodology described herein.

Referring now to FIG. 22, a methodology 2200 that facilitates operating the previously described latch apparatus is illustrated. The methodology 2200 begins at 2202, and at step 2204 includes a latch mechanism angularly moving from a first angular orientation to a second angular orientation while lockingly engaged with a release mechanism. As described previously, such a latch may include: a latch housing; at least one latch slide bolt; and a release weight. Also, the release mechanism may include a release base, a release knob, and at least one release slide bolt. At step 2206, the method may include responsive to step 2204, the release weight moving in at least a portion of the latch housing from a first position to a second position responsive to gravity.

Also at step 2208, the method includes responsive to the release weight moving to the second position in step 2206, the at least one latch slide bolt moving from an extended position to a retracted position relative to the latch housing to cause the at least one latch slide bolt to move out of engagement with the at least one release slide bolt and enable the latch mechanism to disengage from the release mechanism. This corresponds to the waste container moving to a dump angular orientation in which the lid opens to enable dumping the contents of the cavity.

In addition, the method may include a step 2210 in which the latch angularly moves from the second angular orientation to the first angular orientation (back to the upright orientation) whereby the latch mechanism becomes lockingly engaged with the release mechanism with the at least one latch slide bolt and the at least one release slide bolt in engagement with each other.

In addition, the method may include a step 2212 in which the release knob moves relative to the release base from an extended position inwardly to a retracted position and then from a first angular orientation to a second angular orientation relative to the release base. In step 2214, responsive to step 2212, the at least one release slide bolt may move from an extended position outwardly to a retracted position relative to the release base to cause the at least one release slide bolt to move out of engagement with the at least one latch slide bolt and enable the release mechanism to disengage from the latch mechanism. In this example, the knob may not be able to rotate from the first angular orientation to the second angular when the knob is in the extended position.

It is noted that several examples have been provided for purposes of explanation. These examples are not to be construed as limiting the hereto-appended claims. Additionally, it may be recognized that the examples provided herein may be permutated or otherwise changed while still falling under the scope of the claims.

Further, it should be appreciated that while the exemplary embodiments described herein relate to waste containers and particular configurations of the exemplary waste containers, the structures and principles of the exemplary embodiments may be applied to other configurations of waste containers or other types of containment devices, closure structures or latching arrangements in other fields of use.

Thus the exemplary embodiments described herein achieve improved operation, eliminate difficulties encountered in the use of prior devices, systems and methods and attain the useful results described herein.

In the foregoing description certain terms have been used for brevity, clarity and understanding. However, no unnecessary limitations are to be implied therefrom because such terms are used for descriptive purposes and are intended to be broadly construed. Moreover, the descriptions and illustrations herein are by way of examples and the inventive aspects are not limited to the features shown and described.

Further, having described the features, discoveries and principles of the exemplary embodiments, the manner in which they are constructed and operated and the advantages and useful results attained, the new and useful structures, devices, elements, arrangements, parts, combinations, systems, equipment, operations, methods, processes and relationships are set forth in the appended claims.

We claim:

1. Apparatus comprising:

a latch configured for attachment to a material holding receptacle, wherein the receptacle includes a bin and a relatively moveable lid, wherein the lid is moveable between an open lid position and a closed lid position in which an interior cavity of the bin is respectively accessible and inaccessible from outside the receptacle, wherein the latch is configured to be in fixed operatively attached engagement with one of the lid and the bin, wherein the latch includes:

a housing, wherein the housing bounds a closed weight cavity within the housing, at least one latch slide bolt, wherein the at least one latch slide bolt is moveably mounted in operative supported connection with the housing, wherein the at least one latch slide bolt is moveable between extended and retracted positions, wherein the at least one latch slide bolt is configured to engage at least one aperture in the extended position, wherein the at least one aperture is in operatively attached engagement with the other of the bin or the lid, a release weight, wherein the release weight is moveably mounted within the weight cavity of the housing, wherein the release weight is in operative connection with the at least one latch slide bolt, wherein the release weight is configured such that in a dump angular orientation of the latch, corresponding to the opening of the bin being directed downwardly, the release weight is moved within the cavity relative to the housing to cause the at least one latch slide bolt to move from the extended position to the retracted position, wherein in the retracted position the at least one latch slide bolt is disengaged from the at least one aperture and the lid is enabled to move from the closed lid position to the open lid position, wherein in angular orientations other than the dump angular orientation, the release weight is operative not to cause the at least one latch slide bolt to move from the extended position to the retracted position whereby the at least one latch slide bolt remains in engagement with the at least one aperture, at least one manually moveable member, wherein the at least one manually movable member is manually movable from outside the receptacle and in the closed lid position, wherein the at least one manually moveable member is moveable relative to the latch in at least two different directions, wherein the directions include a linear direction, a rotational direction, or both, wherein the at least one manually moveable member is in operative connection with the at least one aperture, wherein movement of the at least one manually moveable member in the at least two different directions is operative to cause the at least one aperture to move relative to the at least one latch slide bolt in the extended position, such that the at least one latch slide bolt in the extended position is no longer in engagement with the at least one aperture, wherein the at least one latch slide bolt and the at least one aperture are disengageable responsive to movement of the at least one manually movable member, whereby the lid is enabled to be moved from the closed lid position to the open lid position in other than the dump angular orientation of the latch.

2. The apparatus according to claim 1 and further including a release, wherein the release includes a release base, a release knob, wherein the at least one manually movable member includes the release knob, and wherein the release knob is rotatable about an axis, and at least one release slide bolt, wherein the at least one release slide bolt includes the at least one aperture, wherein axial movement of the release knob relative to the release base from a first knob axial position to a second knob axial position, and then with the release knob in the second axial position, rotational movement from a first angular position to a second angular position relative to the release base, is operative to cause movement of the at least one release slide bolt to cause the at least one aperture to move to no longer be engaged with the at least one latch slide bolt in the extended position.

3. The apparatus according to claim 2 wherein the latch further includes a push member, wherein the push member extends within the cavity and is movably connected with the latch housing, wherein the push member is configured to move within the cavity in the latch housing from a first push position to a second push position responsive to movement of the release weight in at least a portion of the cavity from the first weight position to the second weight position, wherein the release weight is in the first weight position in angular orientations of the latch other than the dump orientation, and is in the second weight position in the dump orientation, at least one drive member, wherein the at least one drive member is in movably supported connection with the housing and is configured to rotate from a first angular drive position to a second angular drive position responsive to push member movement from the first push position to the second push position, wherein the at least one drive member includes a drive projection, wherein the drive projection is configured to operatively engage the at least one latch slide bolt and cause the at least one latch slide bolt to move from the extended position to the retracted position responsive to the movement of the at least one drive member from the first angular drive position to the second angular drive position, wherein in the retracted position the at least one latch slide bolt is disengaged from the at least one aperture.

4. The apparatus according to claim 3 wherein the push member and the release weight are spaced apart when the release weight is in the first weight position.

5. The apparatus according to claim 4 wherein the at least one latch slide bolt is movable along a first linear direction between the extended position and the retracted position, wherein both the release weight and the push member are movable between the respective first weight position and the first push position, to the respective second weight position and the second push position along a second linear direction, wherein the first linear direction is generally perpendicular to the second linear direction.

6. The apparatus according to claim 4 wherein the latch includes two generally opposed latch slide bolts and at least one spring, wherein the at least one spring is operative to bias the latch slide bolts in opposed directions toward the extended position of each of the latch slide bolts.

7. The apparatus according to claim 3 wherein the latch includes two drive members and two latch slide bolts, wherein each drive member is configured to pivot with respect to a respective pivot axis, wherein each respective drive member is configured to operatively engage and cause a respective one of the latch slide bolts to move from the extended position to the retracted position.

8. The apparatus according to claim 7 wherein the latch further includes at least one spring, wherein the at least one spring is in operative connection with at least one of the latch slide bolts, wherein each respective drive member is operative to cause at least one latch slide bolt to move to the retracted position against the biasing force of the at least one spring.

9. The apparatus according to claim 3 wherein the push member includes a channel bounded by two push arms, wherein one push arm of the pair extends on each opposed side of the channel, wherein when the push member is in the second push position, the pivot axis of each drive member extends in the channel of the push member intermediate of the two push arms.

10. The apparatus according to claim 9 wherein each drive member includes a driven edge surface that is substantially flat, wherein portions of each of the two push arms, each include an arm engaging surface that is substantially flat, wherein push member movement from the first push position to the second push position is operative to cause each of the push arms to operatively engage a respective drive member and move in operative engagement to the respective driven edge surfaces, wherein the substantially flat driven edge surfaces of the drive members and the substantially flat arm engaging surfaces of the push arms extend substantially parallel in the second position of the push member.

11. The apparatus according to claim 6 wherein the release includes two generally opposed release slide bolts, wherein the release includes at least one further spring, wherein the at least one further spring is in operative connection with at least one of the release slide bolts, wherein the at least one further spring is operative to bias at least one of the release slide bolts toward engagement with a respective latch slide bolt, wherein when the latch and release are moved from a position in which they are disengaged to an engaged and latched position, each latch slide bolt and each release slide bolt are enabled to move against the biasing force of the at least one spring and the at least one further spring respectively, whereby each latch slide bolt is enabled to move into latched engagement with a respective release slide bolt.

12. The apparatus according to claim 11 wherein the release knob is in operative connection with a cam surface wherein when the release knob is in the second knob axial position and is rotated in a first angular direction, the cam surface is operative to cause the release slide bolts to move to disengage from each of the latch slide bolts in the extended position.

13. The apparatus according to claim 2 wherein the release knob is in operative connection with a cam surface wherein the release knob is in the second knob axial position and is rotated in a first angular direction, the cam surface is operative to cause the at least one release side bolt to move to be disengaged from the at least one latch slide bolt in the extended position.

14. The apparatus according to claim 13 wherein the release knob is in operative fixed engaged connection with one of a release projection or a release aperture, and the release base is in operative fixed engaged connection with the other of the release projection or release aperture, wherein when the release knob is in the first knob axial position relative to the release base, the release projection and release aperture are in engagement and the release knob is not enabled to rotate in a manner that enables the at least one release slide bolt to move to disengage from the at least one latch slide bolt in the extended position.

15. The apparatus according to claim 12 wherein the release weight is movable within the weight cavity, wherein the latch housing includes an opening adjacent at least one side of the weight cavity, wherein the latch housing is configured to be mounted to a wall surface of the container, such that the wall surface operatively closes the opening and bounds the closed weight cavity.

16. Apparatus comprising:

a latch configured for attachment to a material holding receptacle, wherein the receptacle includes a bin and a relatively moveable lid, wherein the lid is moveable between an open lid position and a closed lid position in which an interior cavity of the bin is respectively accessible and inaccessible from outside the receptacle, wherein the latch is configured to be in fixed attached engagement with one of the lid and the bin, a release, wherein the release is configured to be in fixed attached engagement with the other of the lid and the bin, wherein the release includes at least one release bolt, wherein the latch includes:

a housing, wherein the housing bounds a closed cavity, at least one latch bolt, wherein the at least one latch bolt is moveably mounted in operative supported connection with the housing, wherein the at least one latch bolt is moveable relative to the housing between extended and retracted positions, wherein in the extended position the at least one latch bolt is configured to engage the at least one release bolt, wherein the at least one release bolt is in operatively attached engagement with the other of the bin or the lid, a release weight, wherein the release weight is movable within the cavity of the housing, wherein the release weight is in operative connection with the at least one latch bolt, wherein the release weight is configured such that in a dump angular orientation of the latch, corresponding to the opening of the bin being directed downwardly, the release weight is moved within the cavity relative to the housing to cause the at least one latch bolt to move from the extended position to the retracted position, wherein in the retracted position the at least one latch bolt is disengaged from the at least one release bolt and the lid is enabled to move from the closed lid position to the open lid position, wherein in angular orientations other than the dump angular orientation, the release weight is operative not to cause the at least one latch bolt to move from the extended position to the retracted position, wherein the release includes a manually movable member, wherein movement of the manually movable member is operative to cause movement of the at least one release bolt so that the at least one release bolt is disengaged from the at least one latch bolt in the extended position and the lid is enabled to move from the closed lid position to the open lid position.

17. The apparatus according to claim 16 wherein the manually movable member comprises a knob, wherein the knob is movable relative to the latch in both a linear direction and a rotational direction, wherein manual movement of the knob in a sequence including movement in the linear direction and in a rotational direction is operative to cause the at least one release bolt to move to disengage the at least one latch bolt in the extended position.

18. Apparatus comprising:

a latch configured for attachment to a material holding receptacle, wherein the receptacle includes a bin and a relatively moveable lid, wherein the lid is moveable between an open lid position and a closed lid position in which an interior cavity of the bin is respectively accessible and inaccessible from outside the receptacle, wherein the latch is configured to be in fixed operatively attached engagement with one of the lid and the bin, wherein the latch includes:

a housing, wherein the housing bounds a closed weight cavity within the housing, at least one latch slide bolt, wherein the at least one latch slide bolt is moveably mounted in operative supported connection with the housing, wherein the at least one latch bolt is moveable between extended and retracted positions, wherein the at least one latch slide bolt is configured to engage at least one aperture in the extended position, wherein the at least one aperture is in operatively attached engagement with the other of the bin or the lid, and wherein in the extended position the at least one latch slide bolt is operative to hold the lid in the closed lid position, a release weight, wherein the release weight is moveably mounted within the weight cavity of the housing, wherein the release weight is movable within the housing between a first weight position and a second weight position, wherein the release weight is in the first weight position in angular orientations of the latch other than a dump orientation corresponding to the opening of the bin being directed downwardly, and the release weight is in the second weight position when the latch is in the dump orientation, a push member, wherein the push member extends within the cavity and is movably operatively connected with the latch housing, wherein the push member is configured to move within the cavity in the latch housing from a first push position to a second push position responsive to movement of the release weight in the cavity from the first weight position to the second weight position, at least one drive member, wherein the at least one drive member is in movably operatively supported connection with the housing and is configured to rotate from a first angular drive position to a second angular drive position responsive to push member movement from the first push position to the second push position, wherein the at least one drive member includes a drive projection, wherein the drive projection is configured to operatively engage the at least one latch slide bolt and cause the at least one slide bolt to move from the extended position to the retracted position responsive to the movement of the at least one drive member from the first angular drive position to the second angular drive position, wherein in the retracted position the at least one latch slide bolt is disengaged from the at least one aperture, whereby the lid is enabled to move from the closed lid position to the open lid position when the latch is in the dump orientation.

19. Apparatus comprising:

a latch configured for attachment to a material holding receptacle, wherein the receptacle includes a bin and a relatively moveable lid, wherein the lid is moveable between an open lid position and a closed lid position in which an interior cavity of the bin is respectively accessible and inaccessible from outside the receptacle, wherein the latch is configured to be in fixed operatively attached engagement with one of the lid and the bin, wherein the latch includes:

a housing, wherein the housing bounds a closed weight cavity within the housing, two generally opposed latch slide bolts, wherein the latch slide bolts are movably mounted in operative supported connection with the housing, wherein each latch slide bolt is moveable between extended and retracted positions, at least one spring, wherein the at least one spring is operative to bias each of the latch slide bolts in opposed directions toward the extended position of each of the latch slide bolts, wherein each latch slide bolt is configured to engage a respective aperture in the extended position, wherein each aperture is in operatively attached engagement with the other of the bin or the lid, a release weight, wherein the release weight is moveably mounted within the weight cavity of the housing, wherein the release weight is in operative connection with the at least one latch slide bolt, wherein the release weight is configured such that in a dump angular orientation of the latch, corresponding to the opening of the bin being directed downwardly, the release weight is moved within the cavity relative to the housing to cause each latch slide bolt to move from the extended position to the retracted position, wherein in the retracted position each respective latch slide bolt is disengaged from the respective aperture and the lid is enabled to move from the closed lid position to the open lid position, wherein in angular orientations other than the dump angular orientation, the release weight is operative not to cause each latch slide bolt to move from the respective extended position to the respective retracted position, whereby each latch slide bolt remains in engagement with the respective aperture.

20. Apparatus comprising:

a latch configured for attachment to a material holding receptacle, wherein the receptacle includes a bin and a relatively movable lid, wherein the lid is movable between an open lid position and a closed lid position in which in interior cavity of the bin is respectively accessible and inaccessible from outside the receptacle, wherein the latch is configured to be in fixed operatively attached engagement with one of the lid and the bin, wherein the latch includes a housing, wherein the housing bounds a closed weight cavity within the housing, two generally opposed latch slide bolts, wherein each latch slide bolt is movably mounted in operative supported connection with the housing, wherein each latch slide bolt is movable between first and second positions, wherein each latch slide bolt includes one of a projection and an aperture configured to engage the other of the respective projection and the aperture, wherein the other of the projection and the aperture is in operatively attached engagement with the other of the bin or the lid, at least one spring, wherein the at least one spring is in operative connection with the latch slide bolts, and the at least one spring is operative to bias the latch slide bolts so that the projections and apertures are in engagement, a release weight, wherein the release weight is movably mounted within the closed weight cavity within the housing, wherein the release weight is in operative connection with the last least one latch slide bolt, wherein the release weight is configured such that in a dump angular orientation of the latch corresponding to the opening of the bin being directed downwardly, the release weight is moved relative to the housing by gravity within the weight cavity to cause each of the two latch slide bolts to move against the bias of the at least one spring from the first position wherein each respective projection is in engagement with a respective aperture, to the second position wherein each respective projection is disengaged from each respective aperture, and the lid is enabled to move from the closed lid position to the open lid position, wherein in angular orientations of the latch other than the dump angular orientation, the release weight is operative not to cause each latch slide bolt to move from the first position to the second position whereby each respective projection remains in engagement with each respective aperture to hold the lid in the closed lid position.

21. The apparatus according to claim 18 wherein the at least one latch slide bolt is movable along a first linear direction between the extended position and the retracted position, wherein both the release weight and the push member are movable between the respective first weight position and the first push position, to the respective second weight position and the second push position along a second linear direction, wherein the first linear direction is generally perpendicular to the second linear direction.

22. The apparatus according to claim 18 wherein the push member includes a channel bounded by two push arms, wherein one push arm of the pair extends on each opposed side of the channel, wherein when the push member is in the second push position, the pivot axis of each drive member extends in the channel of the push member intermediate of the two push arms.

23. The apparatus according to claim 22 wherein each drive member includes a driven edge surface that is substantially flat, wherein portions of each of the two push arms, each include an arm engaging surface that is substantially flat, wherein push member movement from the first push position to the second push position is operative to cause each of the push arms to operatively engage a respective drive member and move in operative engagement to the respective driven edge surfaces, wherein the substantially flat driven edge surfaces of the drive members and the substantially flat arm engaging surfaces of the push arms extend substantially parallel in the second position of the push member.

24. The apparatus according to claim 23 wherein operative engagement of the push arms and drive members prevent movement of the push member in a second direction beyond the second push position.

25. The apparatus according to claim 19 wherein the release includes two release slide bolts, wherein the release includes a release receptacle in operative connection with the release base, wherein the release receptacle includes outer side walls that bound a release cavity, wherein the two release slide bolts extend in the release cavity, wherein when the latch is in latched engagement with the release, portions of the latch extend in the release cavity such that the respective latch side bolts and release slide bolts are in engagement in the release cavity.

26. The apparatus according to claim 25 wherein the release receptacle includes opposed walls, wherein each of the two opposed walls include a respective guide flange, wherein the guide flanges are configured to guide portions of the latch that include the latch slide bolts into the release cavity of the release receptacle.

27. The apparatus according to claim 20 wherein the release weight is movable within the closed weight cavity, wherein the latch housing includes an opening adjacent at least one side of the weight cavity, wherein the latch housing is configured to be mounted to a wall surface of the container, such that the wall surface operatively closes the opening and bounds the closed weight cavity.

28. The apparatus according to claim 1 wherein the latch further includes a push member, wherein the push member extends within the cavity and is movably connected with the latch housing, wherein the push member is configured to move in operatively supported connection with the latch housing within the cavity from a first push position to a second push position responsive to movement of the release weight in at least a portion of the latch housing from the first weight position to the second weight position, wherein the release weight is in the first weight position in angular orientations of the latch other than the dump orientation, and is in the second weight position in the dump orientation, at least one drive member, wherein the at least one drive member is in movably supported connection with the housing and is configured to rotate from a first angular drive position to a second angular drive position responsive to push member movement from the first push position to the second push position, wherein the at least one drive member includes a drive projection, wherein the drive projection is configured to operatively engage the at least one latch slide bolt and cause the at least one latch slide bolt to move from the extended position to the retracted position responsive to the movement of the at least one drive member from the first angular drive position to the second angular drive position, wherein in the retracted position the at least one latch slide bolt is disengaged from the at least one aperture.

* * * * *